US005866480A

United States Patent [19]

Murakami et al.

[11] Patent Number: 5,866,480

[45] Date of Patent: Feb. 2, 1999

[54] METHOD AND APPARATUS FOR POLISHING SEMICONDUCTOR SUBSTRATE

[75] Inventors: Tomoyasu Murakami; Mikio Nishio, both of Osaka, Japan

[73] Assignee: Matsushita Electric Industrial Co., Ltd., Osaka, Japan

[21] Appl. No.: 697,509

[22] Filed: Aug. 26, 1996

[30] Foreign Application Priority Data

Sep. 8, 1995 [JP] Japan ..... 7-231355

[51] Int. Cl.[6] ..... H01L 21/304

[52] U.S. Cl. ..... 438/693; 438/747; 438/748; 451/278

[58] Field of Search ..... 438/693, 747, 438/748; 451/278

[56] References Cited

U.S. PATENT DOCUMENTS

| | | | |
|---|---|---|---|
| 4,910,155 | 3/1990 | Cote et al. | 437/8 |
| 5,081,051 | 1/1992 | Mattingly et al. | 437/10 |
| 5,216,843 | 6/1993 | Breivolgel et al. | 51/131.1 |
| 5,308,438 | 5/1994 | Cote et al. | 156/636 |
| 5,341,602 | 8/1994 | Foley | 51/2 R |
| 5,527,424 | 6/1996 | Mullins | 156/636.1 |

FOREIGN PATENT DOCUMENTS

| | | |
|---|---|---|
| 0 674 972 | 10/1995 | European Pat. Off. . |
| 7-156063 | 6/1995 | Japan . |

*Primary Examiner*—Yogendra N. Gupta
*Attorney, Agent, or Firm*—McDermott, Will & Emery

[57] ABSTRACT

A polishing pad is adhered to the top surface of a flat polishing pad holder of a platen. A substrate holding head for holding and rotating a semiconductor substrate is provided above the platen. The semiconductor substrate is rotated and pressed against the polishing pad on the platen. A slurry is supplied in a prescribed amount from a slurry supply pipe onto the polishing pad. A slat-like slurry pushing member for pushing the slurry to a central portion of the platen is provided slidably over the polishing pad. The slurry pushing member is fixed so that an inner portion thereof in a radial direction of the platen is downstream of an outer portion thereof in the radial direction of the platen in the direction of rotation of the platen during polishing.

10 Claims, 17 Drawing Sheets

METHOD AND APPARATUS FOR POLISHING SEMICONDUCTOR SUBSTRATE

BACKGROUND OF THE INVENTION

The present invention relates to a method and apparatus for polishing a semiconductor substrate whereby chemical mechanical polishing (CMP) is performed with respect to a semiconductor substrate of silicon or the like to flatten a surface thereof.

From the 1990s, CMP technology for polishing semiconductor substrates of silicon or the like has shown increasing tendencies toward single-wafer processing as the semiconductor substrates processed by CMP have had larger diameters on the order of 10 cm or more, resulting in an increased amount of slurry consumed per wafer.

By way of example, a conventional apparatus for polishing a semiconductor substrate will be described below with reference to the drawings.

FIG. 22 schematically shows the construction of the conventional polishing apparatus, in which is shown a platen 11 including: a substrate holder 11*a* made of a rigid material and having a flat surface; a rotary shaft 11*b* extending vertically downwardly from the back surface of the substrate holder 11*a;* and rotating means (not shown) for rotating the rotary shaft 11*b*. To the top surface of the substrate holder 11*a* of the platen 11 is adhered a polishing pad 12. Above the platen 11 is provided a substrate holding head 14 which holds and rotates a semiconductor substrate 13. The semiconductor substrate 13 is rotated and pressed against the polishing pad 12 on the platen 11 by the substrate holding head 14. A slurry 15 containing abrasive grains (extremely fine powder for polishing) is dropped in a prescribed amount from a slurry supply pipe 16 onto the polishing pad 12 so as to supply the abrasive grains to the space between the polishing pad 12 and the semiconductor substrate 13.

In the polishing apparatus thus constructed, the polishing pad 12 supplied with the slurry 15 is rotated by rotating the platen 11 and the semiconductor substrate 13 is pressed against the rotating polishing pad 12 by the substrate holding head 14 so that a surface of the semiconductor substrate 13 is polished.

In this process, if the surface of the semiconductor substrate 13 is rugged, the polishing rate is increased at projecting portions of the semiconductor substrate 13 since their contact pressure with the polishing pad 12 is high. On the other hand, the polishing rate is reduced at recessed portions of the semiconductor substrate 13 since their contact pressure with the polishing pad 12 is low. Consequently, the surface of the semiconductor substrate 13 becomes less rugged and more smooth.

However, the above polishing apparatus have the following problems.

When a consideration is given to the amount of supplied slurry and the polishing rate, the polishing rate increases with increases in the amount of supplied slurry 15 and eventually becomes constant when the amount of supplied slurry reaches a given value. Accordingly, the amount of slurry 15 normally supplied onto the polishing pad 12 is slightly larger than the given value with which the polishing rate becomes constant.

However, since the slurry 15 is supplied onto the rotating polishing pad 12 as described above, the slurry 15 is caused to flow to the peripheral portion of the polishing pad 12 by a centrifugal force accompanying the rotation of the platen 11. When the amount of slurry 15 becomes smaller than the given value, the polishing rate is reduced. To compensate for the reduction in the polishing rate, the pressure for pressing the semiconductor substrate 13 against the polishing pad 12 should be increased. However, the increased pressure induces dishing or like phenomenon, which causes such a problem as the degradation of polishing properties. Hence, the slurry should constantly be supplied in an amount slightly larger than the given value with which the polishing rate becomes constant, so that the cost of the slurry accounts for a considerable proportion of the cost of polishing.

To solve the problem, there have been proposed an apparatus and method for polishing wherein a slurry on a polishing pad is prevented from flowing out by a partition board enclosing the polishing pad, as disclosed in U.S. Pat. No. 4,910,155.

According to the apparatus and method for polishing, however, foreign matters such as tips of polishing pad generated at the polishing are accumulated on the polishing pad. Also, water supplied onto the polishing pad to clean up a semiconductor substrate after polishing or perform dressing (the conditioning of the surface of the polishing pad) as well as the slurry is prevented from flowing out, resulting in unfavorable variations in the concentration of the slurry, which changes the polishing properties.

SUMMARY OF THE INVENTION

In view of the foregoing, an object of the present invention is to provide a method and apparatus for polishing a semiconductor substrate wherein a cleaning liquid supplied onto a polishing pad is removed from the top surface thereof, while a slurry supplied onto the polishing pad is held thereon.

A first apparatus for polishing a semiconductor substrate according to the present invention comprises: a platen having a flat surface and rotating around a shaft vertical to the flat surface; a polishing pad disposed on the flat surface of the platen; slurry supplying means for supplying a slurry onto the polishing pad; substrate holding means for holding a semiconductor substrate and pressing it against the polishing pad; and slurry pushing means for pushing, to a central portion of the platen, the slurry supplied onto the polishing pad and caused to flow to a peripheral portion of the platen by a centrifugal force accompanying the rotation of the platen.

In the first apparatus for polishing a semiconductor substrate, the slurry flowing to the peripheral portion of the platen due to a centrifugal force accompanying the rotation of the platen is pushed back to the central portion of the platen by the slurry pushing means to be reused in the polishing of the semiconductor substrate, so that the amount of consumed slurry is reduced.

In the first apparatus for polishing a semiconductor substrate, the slurry pushing means is preferably a pushing plate held over the polishing pad to push, to the central portion of the platen, the slurry brought in contact therewith by the centrifugal force accompanying the rotation of the platen. The arrangement permits the pushing plate to push back, to the central portion of the platen, the slurry brought in contact therewith by the centrifugal force accompanying the rotation of the platen. Thus, the amount of consumed slurry can be reduced by the simple and cost-effective method wherein the pushing plate is provided above the polishing pad.

Preferably, the pushing plate is positioned to intersect a radial direction of the platen such that an inner portion of the pushing plate in the radial direction of the platen is downstream of an outer portion of the pushing plate in the radial direction of the platen in the direction of rotation of the platen during polishing. In the arrangement, the slurry flowing to the peripheral portion of the platen while rotating with the rotation of the platen is caused to change its direction by the pushing plate and flows back to the central portion of the platen while rotating. This enables the slurry to be smoothly returned to the central portion of the platen and efficiently reused.

In this case, the direction in which the slurry flows can be determined based on the speed of the slurry relative to the pushing plate and on a change in velocity vector accompanying a change in kinetic energy caused by a collision of the slurry with the pushing plate. By optimizing the configuration, position, and orientation of the pushing plate in consideration of the rotation speed of the platen, the viscosity of the slurry, and the surface roughness of the polishing pad, the effect of pushing back the slurry to the central portion of the platen can surely be achieved.

Preferably, the pushing plate is provided rotatable in a direction opposite to the rotation of the platen during polishing. When the pushing plate is rotated in the direction opposite to the rotation of the platen during polishing, the cleaning liquid on the polishing pad is pushed to the outside of the platen by the back surface of the pushing plate, so that the cleaning liquid is removed from the top surface of the polishing pad in a short period of time.

Preferably, the pushing plate is provided to have a spacing equal to or smaller than the thickness of a layer of the slurry supplied onto the polishing pad between the pushing plate itself and a top surface of the polishing pad. The arrangement permits the pushing plate to come in contact with the slurry and push it back to the central portion of the platen, while keeping the pushing plate from contact with the polishing pad. Consequently, powder does not result from the friction between the pushing plate and the polishing pad.

Preferably, the pushing plate is made of a flexible material and provided such that a back surface of the pushing plate is in contact with a top surface of the polishing pad. In the arrangement, the lower portion of the pushing plate is deformed to follow the configuration of the top surface of the polishing pad so that no space is formed between the back surface of the pushing plate and the top surface of the polishing pad. Consequently, the slurry is pushed back to the central portion of the platen and reused more efficiently.

Preferably, the pushing plate has a slurry collecting portion for collecting the slurry at an outer portion thereof in a radial direction of the platen and a slurry pushing portion for pushing the slurry collected by the slurry collecting portion to the central portion of the platen at an inner portion thereof in the radial direction of the platen. In the arrangement, the slurry flowing to the peripheral portion can be collected more positively by the slurry collecting portion and the slurry collected by the slurry collecting portion can be pushed back to the central portion of the platen by the slurry pushing member. Accordingly, the amount of slurry flowing out of the top surface of the polishing pad can further be reduced, resulting in more efficient reuse of the slurry.

Preferably, a plurality of pushing plates are spaced along the periphery of the platen. The arrangement further reduces the amount of slurry flowing out of the top surface of the polishing pad, resulting in more efficient reuse of the slurry. On the other hand, the cleaning liquid on the polishing pad is removed through the space between the pushing plates.

In the first apparatus for polishing a semiconductor substrate, the slurry pushing means is preferably gas ejecting means for ejecting a gas for pushing the slurry on the polishing pad to a central portion of the platen. By controlling the flow rate and pressure of the gas ejected from the gas ejecting means in the arrangement, the slurry can be pushed properly back to the central portion of the platen depending on flow characteristics such as the amount and viscosity of the slurry. On the other hand, the cleaning liquid can be removed smoothly from the top surface of the polishing pad by halting the ejection of the gas.

Preferably, a plurality of gas ejecting means are provided along the periphery of the platen. With the arrangement, the amount of slurry flowing out of the top surface of the polishing pad is further reduced, resulting in more efficient reuse of the slurry.

In the first apparatus for polishing a semiconductor substrate, the slurry pushing means is preferably a rotary member provided in contact with or slightly spaced from a top surface of the polishing pad and rotating in a direction opposite to the rotation of the platen. In the arrangement, the slurry flowing to the peripheral portion of the platen while rotating with the rotation of the platen is brought in contact with the outer circumferential surface of the rotary member rotating in the direction opposite to the rotation of the platen and caused to flow to the central portion of the platen along the outer circumferential surface. The slurry thus smoothly returned to the central portion of the platen can be reused efficiently.

More preferably, the rotary member has a projecting portion on the outer circumferential surface thereof. In the arrangement, the slurry flowing to the peripheral portion of the platen with the rotation of the platen is caused to flow back to the central portion of the platen by the projecting portion provided on the outer circumferential surface of the rotary member. Accordingly, the amount of slurry flowing out of the top surface of the polishing pad can further be reduced, resulting in more efficient reuse of the slurry.

A second apparatus for polishing a semiconductor substrate according to the present invention comprises: a platen having a flat surface and rotating around a shaft vertical to the flat surface; a polishing pad disposed on the flat surface of the platen; slurry supplying means for supplying a slurry onto the polishing pad; substrate holding means for holding a semiconductor substrate and pressing it against the polishing pad; and a slurry holding member provided on an edge portion of the platen such that an inner portion of the slurry holding member in a radial direction of the platen is downstream of an outer portion of the slurry holding member in the radial direction of the platen in the direction of rotation of the platen during polishing so as to hold the slurry supplied onto the polishing pad and caused to flow to a peripheral portion of the platen by a centrifugal force accompanying the rotation of the platen on the polishing pad.

In the second apparatus for polishing a semiconductor substrate, the slurry flowing to the peripheral portion of the platen while rotating with the rotation of the platen is caused to change its direction by the slurry holding member and held on the polishing pad to be reused in the polishing of the substrate. Thus, the amount of consumed slurry can be reduced by the simple and cost-effective method.

In the second apparatus for polishing a semiconductor substrate, a plurality of slurry holding members are preferably spaced along the periphery of the platen. The arrangement further reduces the amount of slurry flowing out of the top surface of the polishing pad, resulting in more efficient reuse of the slurry. On the other hand, the cleaning liquid on the polishing pad is removed through the space between the slurry holding members.

Of the plurality of slurry holding members, adjacent ones are more preferably overlapping in the radial direction of the platen. The arrangement further reduces the amount of slurry flowing out of the polishing pad, resulting in more efficient reuse of the slurry.

In the second apparatus for polishing a semiconductor substrate, the slurry holding member is preferably provided movable upwardly, downwardly, or outwardly from the polishing pad and the substrate holding member is provided movable in a plane in parallel with the polishing pad while holding the semiconductor substrate.

After the slurry holding member is moved upwardly, downwardly, or outwardly from the polishing pad, the slurry holding member is moved in a plane in parallel with the polishing pad such that at least a part of the semiconductor substrate protrudes from the polishing pad to reduce the adhesion of the polishing pad to the semiconductor substrate. Thus, the semiconductor substrate can easily be unloaded from the top surface of the polishing pad.

A first method of polishing a semiconductor substrate according to the present invention comprises: a slurry supplying step of supplying a slurry onto a polishing pad disposed on a flat surface of a platen rotating around a shaft vertical to the flat surface; a substrate polishing step of polishing a semiconductor substrate by pressing it against the polishing pad; and a slurry pushing step of pushing, to a central portion of the platen, the slurry supplied onto the polishing pad and caused to flow to a peripheral portion of the platen by a centrifugal force accompanying the rotation of the platen.

According to the first method of polishing a semiconductor substrate, the slurry flowing to the peripheral portion of the platen due to a centrifugal force accompanying the rotation of the platen is pushed back to the central portion of the platen to be reused in the polishing of the substrate, so that the amount of consumed slurry is reduced.

In the first method of polishing a semiconductor substrate, the slurry pushing step preferably includes a step of pushing the slurry on the polishing pad to the central portion of the platen by means of a pushing plate held over the polishing pad. With the arrangement, the slurry flowing to the peripheral portion of the platen due to the centrifugal force accompanying the rotation of the platen is pushed back to the central portion of the platen to be reused in the polishing of the semiconductor substrate, so that the amount of consumed slurry is reduced.

In the first method of polishing a semiconductor substrate, the slurry pushing step preferably includes a step of pushing the slurry on the polishing pad to the central portion of the platen by means of the pushing plate positioned to intersect a radial direction of the platen such that an inner portion of the pushing plate in the radial direction of the platen is downstream of an outer portion of the pushing plate in the radial direction of the platen in the direction of rotation of the platen during polishing. With the arrangement, the slurry flowing to the peripheral portion of the platen while rotating with the rotation of the platen is caused to flow back to the central portion of the platen while being rotated by the pushing plate. The slurry thus smoothly returned to the central portion of the platen can be reused efficiently.

In the first method of polishing a semiconductor substrate, the slurry pushing step preferably includes a step of pushing the slurry supplied onto the polishing pad to the central portion of the platen by means of the pushing plate provided to have a spacing equal to or smaller than the thickness of a layer of the slurry on the polishing pad between the pushing plate itself and a top surface of the polishing pad. The arrangement permits the pushing plate to push the slurry in contact therewith back to the central portion of the platen, while keeping the pushing plate from contact with the polishing pad, so that powder does not result from the friction between the pushing plate and the polishing pad.

In the first method of polishing a semiconductor substrate, the slurry pushing step preferably includes a step of pushing the slurry on the polishing pad to the central portion of the platen by means of the pushing plate made of a flexible material and provided such that a back surface thereof is in contact with a top surface of the polishing pad. With the arrangement, the lower portion of the pushing plate is deformed in accordance with the configuration of the top surface of the polishing pad so that no space is formed between the back surface of the pushing plate and the top surface of the polishing pad. Consequently, the slurry is pushed back to the central portion of the platen and reused more efficiently.

Preferably, the first method of polishing a semiconductor substrate, further comprises a cleaning-liquid removing step of removing a cleaning liquid supplied onto the polishing pad by rotating the platen in a direction opposite to the rotation of the platen during polishing. When the platen is rotated in the direction opposite to the rotation of the platen during polishing, the pushing plate relatively rotates in the direction opposite to the rotation of the platen, so that the cleaning liquid on the polishing pad is pushed to the outside of the platen by the back surface of the pushing plate. Accordingly, the cleaning liquid can be removed from the top surface of the polishing pad in a short period of time.

In the first method of polishing a semiconductor substrate, the slurry pushing step preferably includes a step of ejecting a gas toward a central portion of the platen to push the slurry on the polishing pad to the central portion of the platen. By controlling the flow rate and pressure of the gas ejected toward the central portion of the platen in the arrangement, the slurry can be pushed properly back to the central portion of the platen depending on flow characteristics such as the amount and viscosity of the slurry. On the other hand, the cleaning liquid can be removed smoothly from the top surface of the polishing pad by halting the ejection of the gas.

In the first method of polishing a semiconductor substrate, the slurry pushing step preferably includes a step of pushing the slurry on the polishing pad to the central portion of the platen by means of a rotary member provided in contact with or slightly spaced from a top surface of the polishing pad and rotating in a direction opposite to the rotation of the platen. With the arrangement, the slurry flowing to the peripheral portion of the platen while rotating with the rotation of the platen collides with the outer circumferential surface of the rotary member and is caused to flow back to the central portion of the platen along the outer circumferential surface. The slurry thus smoothly returned to the central portion of the platen can be reused efficiently.

A second method of polishing a semiconductor substrate according to the present invention comprises: a slurry supplying step of supplying a slurry onto a polishing pad disposed on a flat surface of a platen rotating around a shaft vertical to the flat surface; a substrate polishing step of polishing a semiconductor substrate by pressing it against the polishing pad; and a slurry holding step of holding the slurry supplied onto the polishing pad and caused to flow to a peripheral portion of the platen by a centrifugal force accompanying the rotation of the platen on the polishing pad by means of a slurry holding member fixed to an edge portion of the platen such that an inner portion of the slurry holding member in a radial direction of the platen is downstream of an outer portion of the slurry holding member in the radial direction of the platen in the direction of rotation of the platen during polishing.

According to the second method of polishing a semiconductor substrate, the slurry flowing to the peripheral portion of the platen while rotating with the rotation of the platen is caused to change its direction by the slurry holding member and flows back to the central portion of the platen while rotating. Accordingly, the slurry can be held positively on the polishing pad and reused efficiently. Thus, the amount of consumed slurry can be reduced by the simple and cost-effective method.

In the second method of polishing a semiconductor substrate, the slurry holding step preferably includes a step of holding the slurry on the polishing pad by means of a plurality of slurry holding members spaced along the periphery of the platen. The arrangement further reduces the amount of slurry flowing out of the top surface of the polishing pad, resulting in more efficient reuse of the slurry, while the cleaning liquid on the polishing pad is removed through the space between the slurry holding members.

In the second method of polishing a semiconductor substrate, the slurry holding step preferably includes a step of holding the slurry on the polishing pad by means of the plurality of slurry holding members of which adjacent ones are overlapping in the radial direction of the platen. The arrangement further reduces the amount of slurry flowing out of the top surface of the polishing pad, resulting in more efficient use of the slurry.

Preferably, the second method of polishing a semiconductor substrate further comprises a cleaning-liquid removing step of removing a cleaning liquid supplied onto the polishing pad by rotating the platen in a direction opposite to the rotation of the platen during polishing. When the platen is rotated in the direction opposite to the rotation of the platen during polishing, the slurry holding member relatively rotates in the direction opposite to the rotation of the platen, so that the cleaning liquid on the polishing pad is pushed to the outside of the platen by the back surface of the slurry holding member. Accordingly, the cleaning liquid can be removed from the top surface of the polishing pad in a short period of time.

Preferably, the second method of polishing a semiconductor substrate further comprises: a slurry-holding-member moving step of moving the slurry holding member upwardly, downwardly, or outwardly from the polishing pad; and a substrate moving step of moving the semiconductor substrate in a plane in parallel with the polishing pad such that at least a part of the semiconductor substrate thrusts out from the polishing pad. The arrangement reduces the adhesion of the polishing pad to the semiconductor substrate so that the semiconductor substrate is easily unloaded from the top surface of the polishing pad.

DETAILED DESCRIPTION OF THE INVENTION

Below, polishing methods and polishing apparatus according to the individual embodiments of the present invention will be described with reference to the drawings.

(First Embodiment)

Figure 1:
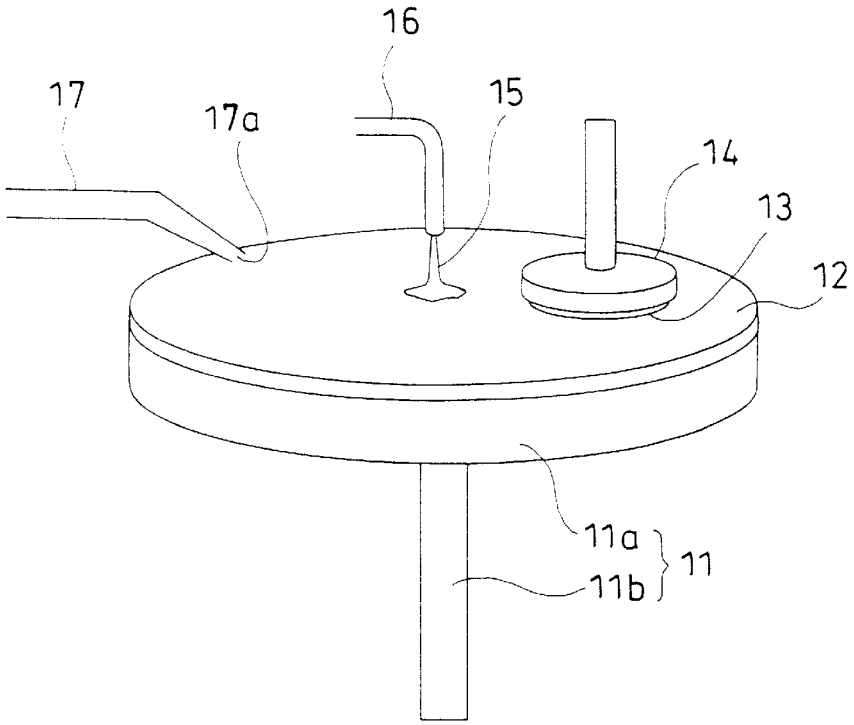
FIG. 1 is a perspective view of an apparatus for polishing a semiconductor substrate according to a first embodiment.

FIG. 1 is a schematic perspective view of a polishing apparatus according to a first embodiment of the present invention, in which is shown a platen 11 including: a polishing-pad holder 11*a* made of a rigid material and having a flat surface; a rotary shaft 11*b* extending vertically downwardly from the back surface of the polishing-pad holder 11*a;* and rotating means (not shown) for rotating the rotary shaft 11*b*. To the top surface of the polishing-pad holder 11*a* is adhered a polishing pad 12 made of polyurethane or like material. Above the platen 11, there is provided a substrate holding head 14 which holds and rotates a semiconductor substrate 13. The semiconductor substrate 13 is rotated and pressed against the polishing pad 12 on the platen 11 by the substrate holding head 14. A slurry 15 containing abrasive grains is dropped in a prescribed amount from a slurry supply pipe 16 onto the polishing pad 12 and supplied to the space between the polishing pad 12 and the semiconductor substrate 13 by rotating the platen 11 and the substrate holding head 14.

The first embodiment is characterized in that a compressed-air supply pipe 17 for ejecting a compressed air to the top surface of the polishing pad 12 is provided as slurry pushing means over the periphery of the polishing pad 12. An ejection hole 17*a* of the compressed-air supply pipe 17 is opened to face the center of rotation of the platen 11. The ejection hole 17*a* has a diameter of, e.g., about 3 mm and the flow speed of the compressed air ejected from the ejection hole 17*a* is set at about 5 m/second. With the arrangement, the compressed air ejected from the ejection hole 17*a* of the compressed-air supply pipe 17 is supplied from the slurry supply pipe 16 to the top surface of the polishing pad 12 to push the slurry 15 directed to the peripheral portion by a centrifugal force accompanying the rotation of the platen 11 back to the central portion of the platen 11. As a result, the slurry 15 reciprocates between the central and peripheral portions of the platen 11 to equally provide the abrasive grains over the top surface of the semiconductor substrate 13.

The diameter of the ejection hole 15*a* and the flow speed of the compressed air are not limited to the foregoing. Any diameter and any speed may be selected properly provided that the slurry 15 on the polishing pad 12 is pushed back to the central portion of the platen 11. Although the ejection hole 17*a* of the compressed-air supply pipe 17 is opened to face the center of rotation of the platen 11, it may face any direction provided that the gas ejected from the ejection hole 17*a* is capable of causing the slurry 15 on the polishing pad 12 to flow to the center of rotation of the platen 11.

The number of ejection holes 17*a* of the compressed-air supply pipe 17 is not particularly limited. However, a plurality of, e.g., 5 or 6 ejection holes 17*a* are preferably provided.

Although the first embodiment has used the compressed air as the gas to be ejected, similar effects are achieved by using any other gas. However, an inert gas such as a nitrogen gas is preferably ejected depending on the type of the slurry, since the inert gas exhibits chemical stability to the slurry.

Although the slurry 15 contains the abrasive grains in the above first embodiment, the slurry 15 may be a liquid containing no abrasive grain. Any flowable slurry may be used extensively. The same shall apply to each of the embodiments which will be described below.

(Second Embodiment)

Figure 2:
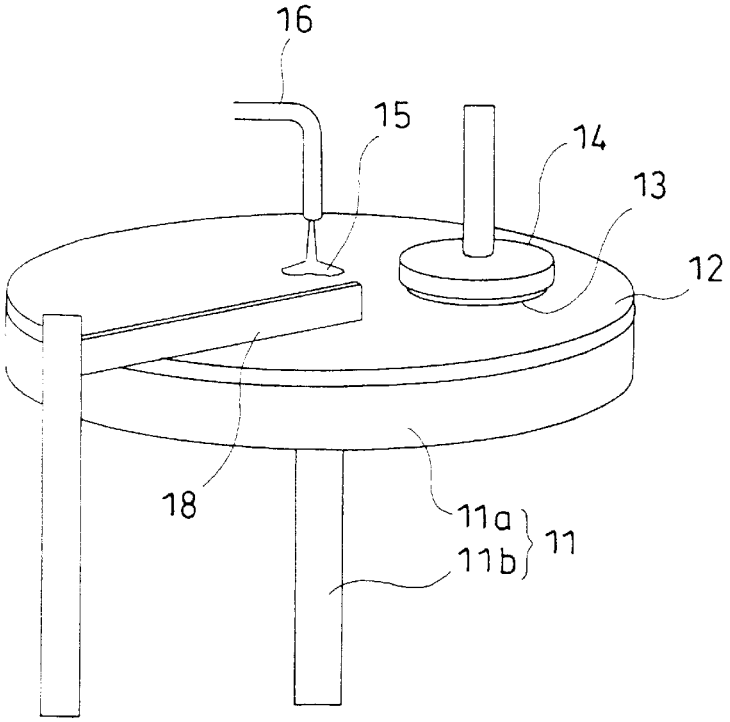
FIG. 2 is a perspective view of an apparatus for polishing a semiconductor substrate according to a second embodiment.
Figure 3:
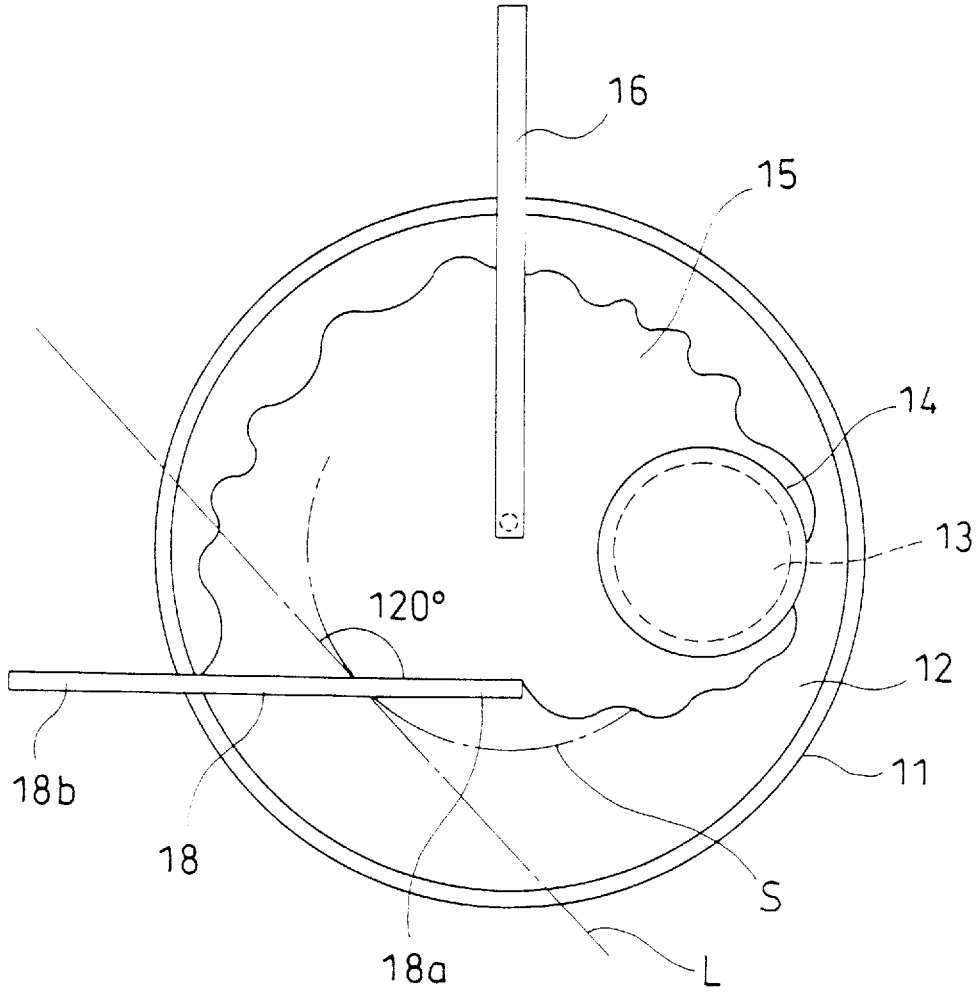
FIG. 3 is a plan view of the apparatus for polishing a semiconductor substrate according to the second embodiment.

FIGS. 2 and 3 schematically show the construction of a polishing apparatus according to a second embodiment of the present invention, of which FIG. 2 is a perspective view and FIG. 3 is a plan view.

The second embodiment comprises: a platen 11; a polishing pad 12; a substrate holding head 14; and a slurry supply pipe 16, similarly to the first embodiment. A semiconductor substrate 13 is rotated and pressed against the polishing pad 12 on the platen 11. A slurry 15 is supplied in a prescribed amount from the slurry supply pipe 16 onto the polishing pad 12.

The second embodiment is characterized in that a slat-like slurry pushing member 18 made of, e.g., polyurethane foam is provided as the slurry pushing means for pushing the slurry 15 to the central portion of the platen 11 by sliding over the polishing pad 12. As shown in FIG. 3, the slurry pushing member 18 is fixed such that an inner portion 18*a* thereof in a radial direction of the platen 11 is positioned downstream (forward) of an outer portion 18*b* thereof in the radial direction of the platen 11 in the direction of rotation of the platen 11 during polishing. Specifically, the slurry pushing member 18 is fixed such that the tangent L to the circle S centering around the center of rotation of the platen 11 and the slurry pushing member 18 intersect each other to form an angle of 120° therebetween.

With the arrangement, the slurry 15 supplied from the slurry supply pipe 16 onto the polishing pad 12 and caused to flow to the outside of the platen 11 by a centrifugal force accompanying the rotation of the platen 11 is returned to the central portion of the platen 11 by the surface of the slurry pushing member 18, evenly spread over the polishing pad 12, and supplied to the semiconductor substrate 13. In the case of removing a cleaning liquid such as water from the top surface of the polishing pad 12, the removal is promoted if the platen 11 is rotated in the direction opposite to the rotation of the platen 11 during polishing, since the cleaning liquid is brought in contact with the back surface of the slurry pushing member 18 by the rotation of the platen 11 in the opposite direction.

The length and angle of the slurry pushing member 18 may be selected properly provided that the slurry pushing member 18 returns the slurry 15 on the polishing pad 12 to the central portion of the platen 11.

Although the angle between the slurry pushing member 18 and a radius of the platen 11 is invariable in the second embodiment, the angle between the slurry pushing member 18 and a radius of the platen 11 may be variable such that the slurry 15 is returned efficiently to the central portion of the platen 11 depending on the viscosity of the slurry 15 and on the rotation speed of the platen 11.

Although the slurry pushing member 18 is fixed, it may be rotated in a direction relatively opposite to the rotation of the platen 11 during polishing. In this case, it is necessary to provide the slurry pushing member 18 of such a length in such a position as to prevent the slurry pushing member 18 from colliding with the substrate holding head 14. In the arrangement, the cleaning liquid supplied onto the polishing pad 12 can be removed efficiently by the back surface of the slurry pushing member 18.

Figure 4:
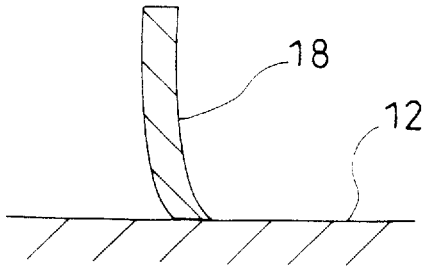
FIG. 4 is a plan view showing a variation of a pushing plate in the apparatus for polishing a semiconductor substrate according to the second embodiment.
Figure 5A:
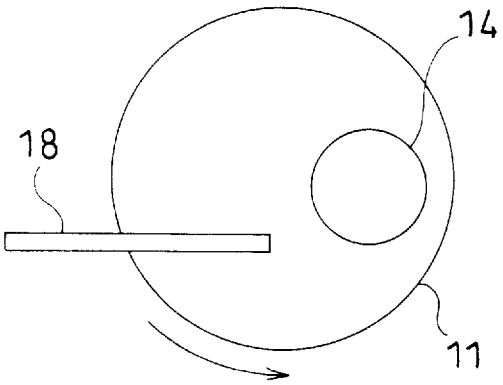
FIGS. 5(*a*) to 5(*d*) are plan views showing respective variations of the pushing plate in the apparatus for polishing a semiconductor substrate according to the second embodiment.
Figure 5C:
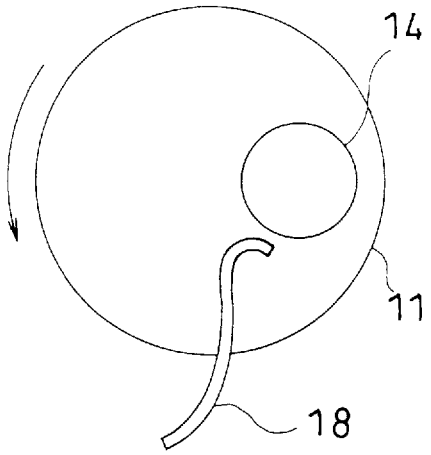
Figure 5B:
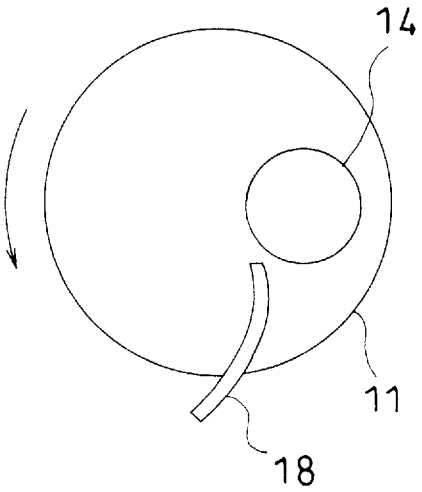
Figure 5D:
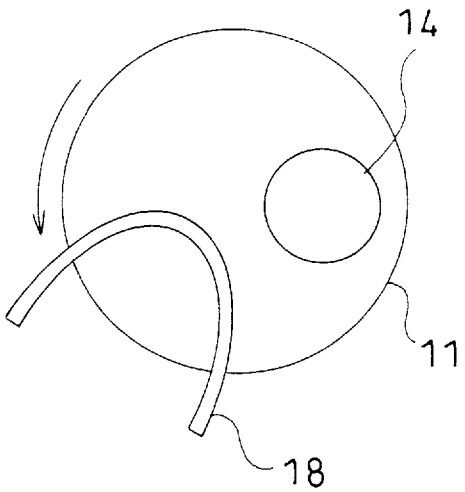
Figure 6A:
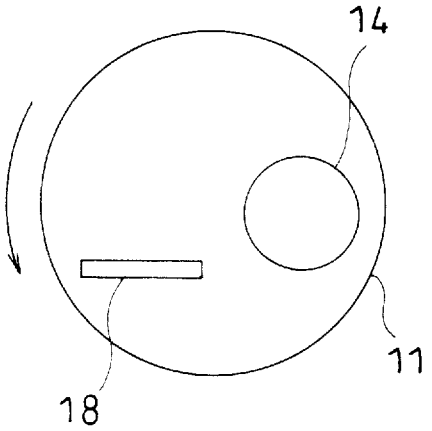
FIGS. 6(*a*) to 6(*d*) are cross-sectional views showing the respective variations of the pushing plate in the apparatus for polishing a semiconductor substrate according to the second embodiment.
Figure 6B:
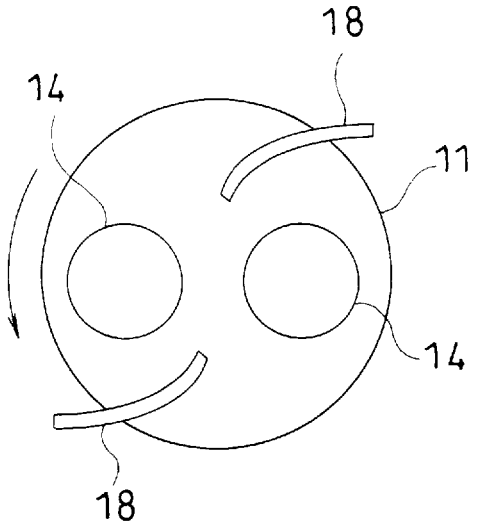
Figure 6C:
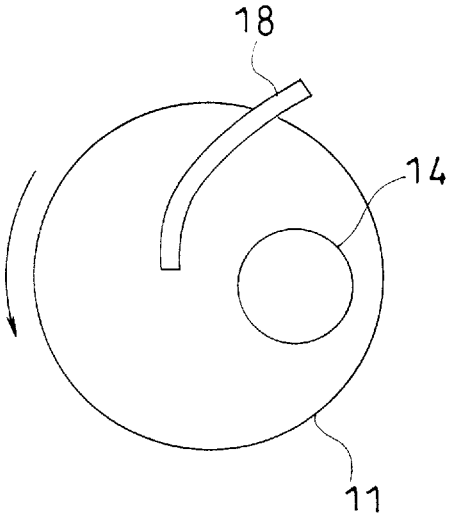
Figure 6D:
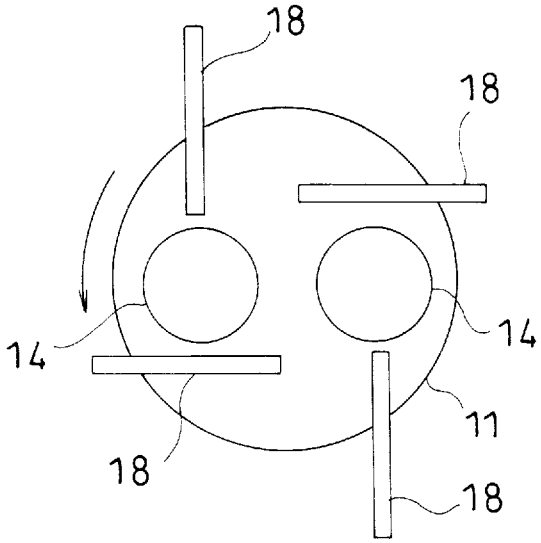

The material of the slurry pushing member 18 is not limited to polyurethane foam but any other material may be used instead. However, the use of a soft material such as one containing polyethylene, polypropylene, polystyrene, polyvinyl chloride, or Teflon as the main component or rubber such as butadiene rubber is particularly preferred, since the slurry pushing member 18 made of such a material is deformed to follow the surface configuration of the polishing pad 12, as shown in FIG. 4.

There may be provided a space sufficiently large to permit the slurry 15 to be returned to the central portion of the platen 11 (space with a height equal to or less than the thickness of the layer of the slurry 15) between the slurry pushing member 18 and the polishing pad 12 so that the slurry pushing member 18 is kept from rubbing against the polishing pad 12. The arrangement is preferred since it is free from powder resulting from the rubbing of the slurry pushing member 18 against the polishing pad 12.

FIGS. 5(*a*) to 5(*d*) and FIGS. 6(*a*) to 6(*d*) show variations of the slurry pushing member 18 in terms of the configuration and number thereof. As shown in the drawings, the configuration and number of the slurry pushing members 18 are not limited but can be changed properly depending on the viscosity of the slurry 15 and the rotation speed of the platen 11. As shown in FIG. 5(*b*) or 5(*c*), the slurry pushing member 18 may be curved such that the outer portion thereof in the radial direction of the platen 11 has the function of collecting the slurry 15 and that the inner portion thereof in the radial direction of the platen 11 has the function of pushing the collected slurry 15 toward the substrate holding head 14.

Below, a polishing method using the polishing apparatus according to the second embodiment will be described with reference to FIGS. 7.

Figure 7A:
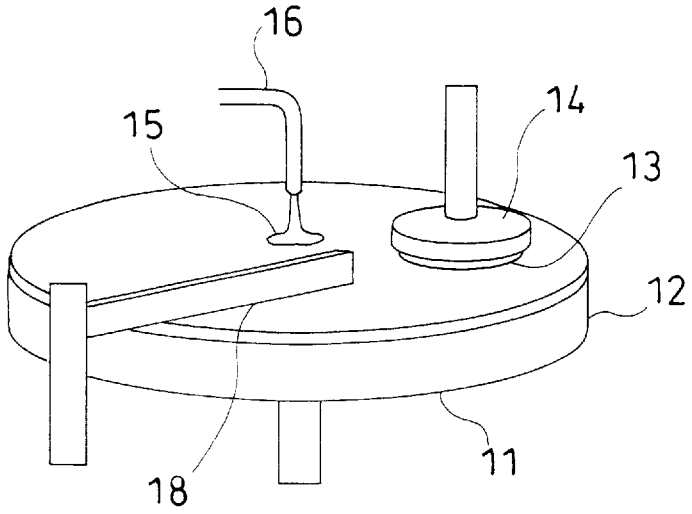
FIGS. 7(*a*) to 7(*c*) are perspective views illustrating a polishing method using the apparatus for polishing a semiconductor substrate according to the second embodiment.
Figure 7B:
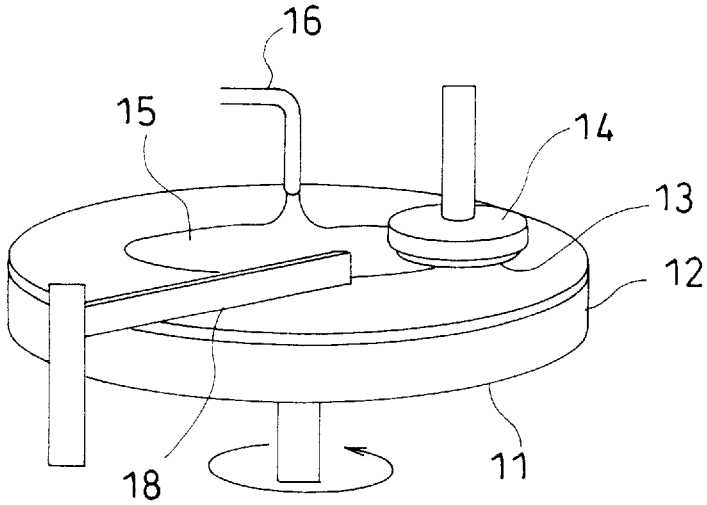
Figure 7C:
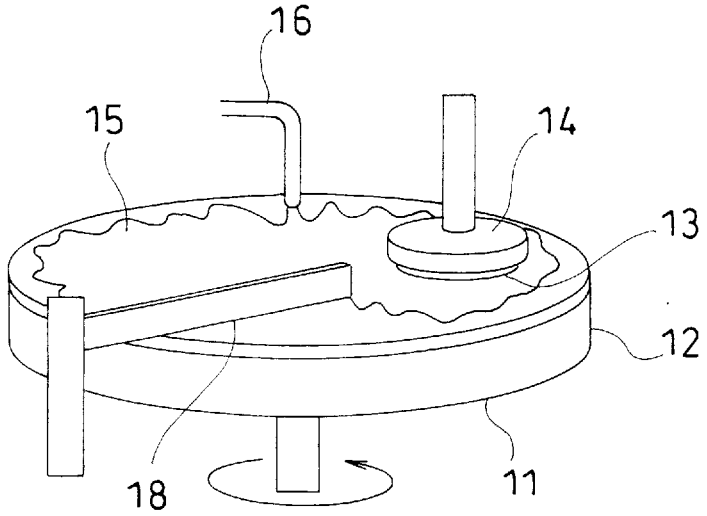

Initially, as shown in FIG. 7(*a*), the semiconductor substrate 13 is attached to the substrate holding head 14 with a face to be polished facing downward.

Next, as shown in FIG. 7(*b*), the slurry 15 is supplied from the slurry supply pipe 16 onto a portion of the polishing pad 12 corresponding to the near-central portion of the platen 11, while the platen 11 and the substrate holding head 14 are rotated counterclockwise (CCW). As a result, the slurry 15 is caused to flow to the peripheral portion of the polishing pad 12 by a centrifugal force accompanying the rotation of the platen 11 to be supplied to the interface between the semiconductor substrate 13 and the polishing pad 12.

As shown in FIG. 7(*c*), the slurry 15 on the polishing pad 12 tends to flow toward the outside of the polishing pad 12 due to the centrifugal force accompanying the rotation of the platen 11. However, the slurry 15 is brought in contact with the slurry pushing member 18 in one complete rotation of the platen 11 and returned to the central portion of the polishing pad 12 to be reused in the polishing of the semiconductor substrate 13.

When the polishing of the semiconductor substrate 13 is completed, a cleaning liquid such as water is supplied onto the polishing pad 12 to clean the surface to be polished of the semiconductor substrate 13 and remove the slurry 15 from the top surface of the polishing pad 12. Thereafter, the platen 11 is rotated clockwise (CW) to remove the slurry remaining on the platen 11 and polishing pad 12. As a result, the cleaning liquid is pushed to the outside of the polishing pad 12 so that the cleaning liquid is removed more efficiently than in the case where the slurry pushing member 18 is not provided.

Although the platen 11 and the substrate holding head 14 are rotated after the slurry 15 is supplied in the foregoing polishing method, the timing of rotating the platen 11 and the substrate holding head 14 and the timing of supplying the slurry 15 can be changed as necessary provided that the slurry 15 is supplied prior to the rotation of the platen 11.

Although the platen 11 is rotated CCW during polishing and CW during the removal of the cleaning liquid, the polishing effect by the slurry 15 remains substantially the same even when the platen 11 is continuously rotated CCW during the removal of the cleaning liquid, except for a slight reduction in the speed at which the cleaning liquid is removed.

The slurry 15 may be supplied onto a portion other than the portion of the polishing pad 12 corresponding to the near-central portion of the platen 11 provided that it is interior to the outer end of the slurry pushing member 18.

(Third Embodiment)

Figure 8:
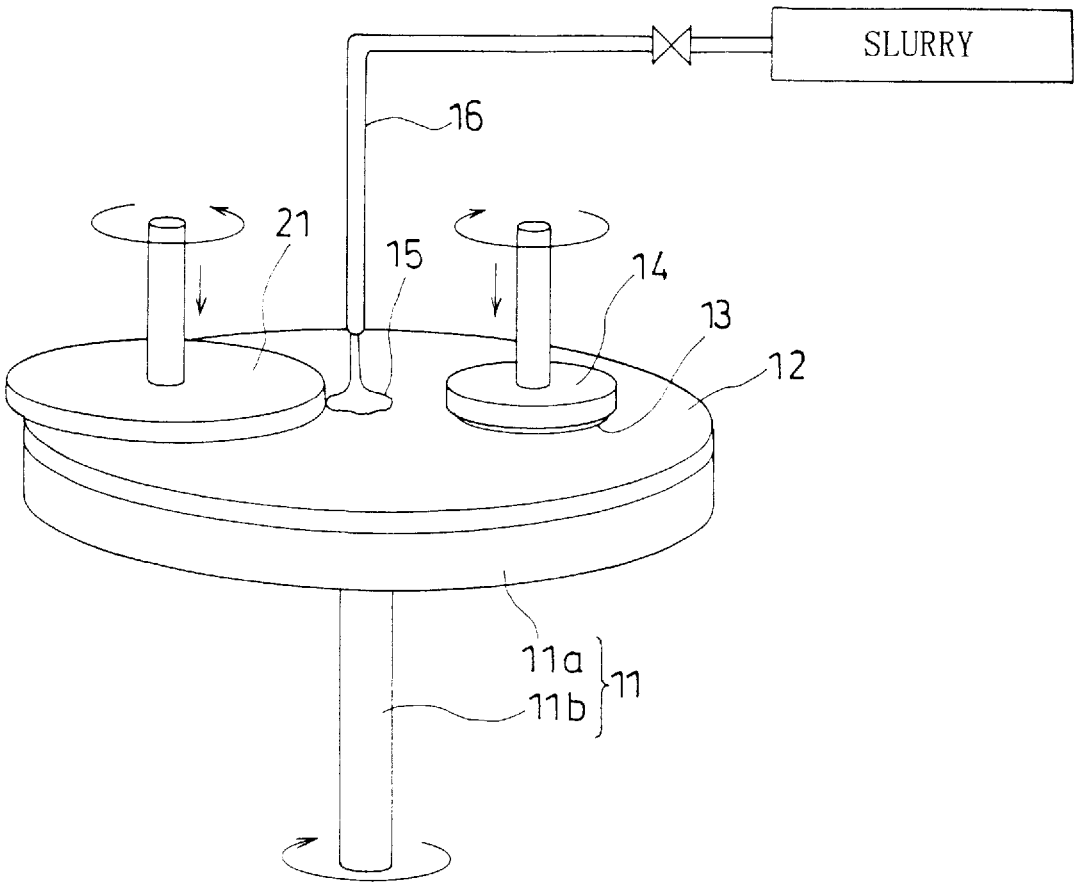
FIG. 8 is a perspective view of an apparatus for polishing a semiconductor substrate according to a third embodiment.

FIG. 8 is a perspective view schematically showing the construction of the polishing apparatus according to a third embodiment of the present invention. The third embodiment comprises: a platen 11; a polishing pad 12; a substrate holding head 14; and a slurry supply pipe 16, similarly to the first embodiment. A semiconductor substrate 13 is rotated and pressed against the polishing pad 12 on the platen 11. A slurry 15 is supplied in a prescribed amount from the slurry supply pipe 16 onto the polishing pad 12.

The third embodiment is characterized in that a circular rotary member 21 as rotatable slurry pushing means is provided in close contact with or slightly spaced from the top surface of the polishing pad 12 on the side opposite to the substrate holding head 14. The diameter of the rotary member 21 is determined to be larger than the diameter of the substrate holding head 14. The rotary member 21 partially projects from the edge of the polishing pad 12. The rotary member 21 rotates in the direction opposite to the rotation of the platen 11 during polishing, while rotating in the same direction as the rotation of the platen 11 during the removal of the cleaning liquid or the like.

Figure 9:
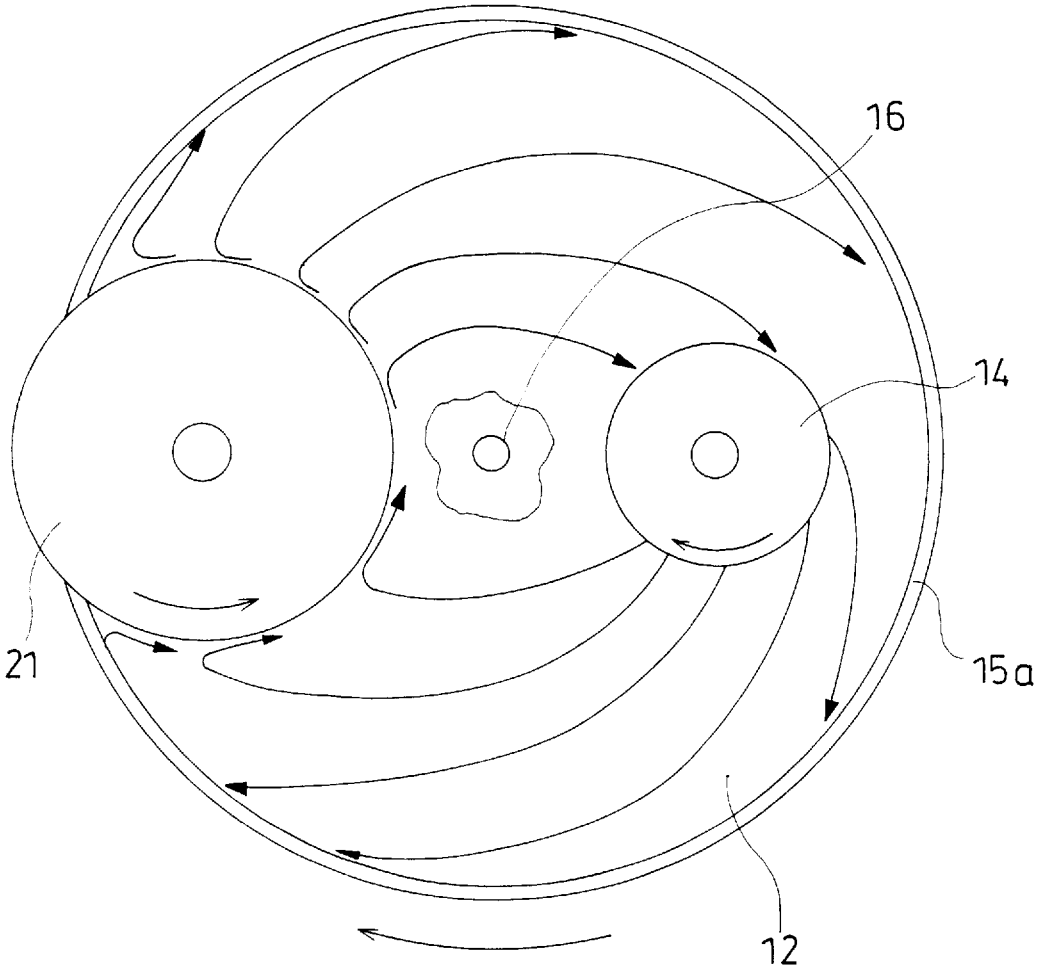
FIG. 9 is a plan view illustrating polishing performed by using the apparatus for polishing the semiconductor substrate according to the third embodiment.
Figure 10:
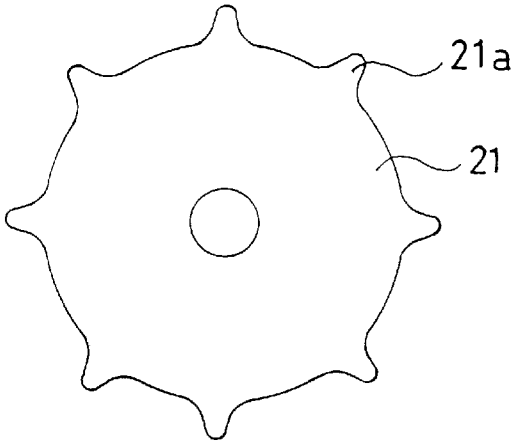
FIG. 10 is a plan view showing a variation of a rotary member in the apparatus for polishing a semiconductor substrate according to the third embodiment.

Thus, as shown in FIG. 9, the slurry 15 supplied from the slurry supply pipe 16 onto the polishing pad 12 and directed to the peripheral portion of the platen 11 by a centrifugal force accompanying the rotation of the platen 11 is brought in contact with the outer circumferential surface of the rotary member 21, returned to the central portion of the platen 11 along the outer circumferential surface of the rotary member 21, and evenly spread over the polishing pad 12 to be supplied to the semiconductor substrate 13. The arrow above the polishing pad 12 in FIG. 9 conceptually indicates the flow direction of the slurry 15 during polishing. In this case, although the slurry 15 is formed into a swell 15*a* by the surface tension thereof on the peripheral portion of the polishing pad 12, the swell 15*a* is eventually pushed back to the central portion of the platen 11 during the rotation of the rotary member 21 since the rotary member 21 partially projects from the edge of the polishing pad 12.

In removing the cleaning liquid from the top surface of the polishing pad 12, on the other hand, the removal of the cleaning liquid is promoted since the cleaning liquid flows to the outside of the platen 11 along the outer circumferential surface of the rotary member 21 rotating in the same direction as the platen 11.

The plan configuration of the rotary member 21 is not limited to a circle. The provision of projecting portions 21*a* on the outer circumferential surface of the rotary member 21 enhances the effect of pushing the slurry 15 back to the central portion of the platen 11 along the outer circumferential surface of the rotary member 21 rotating in the direction opposite to the rotation of the platen 11. Although the dedicated rotary member 21 is provided as the slurry pushing means in the third embodiment, a rotary member of the same configuration as that of the substrate holding head 14 may be provided in place of the dedicated rotary member 21.

(Fourth Embodiment)

Figure 11:
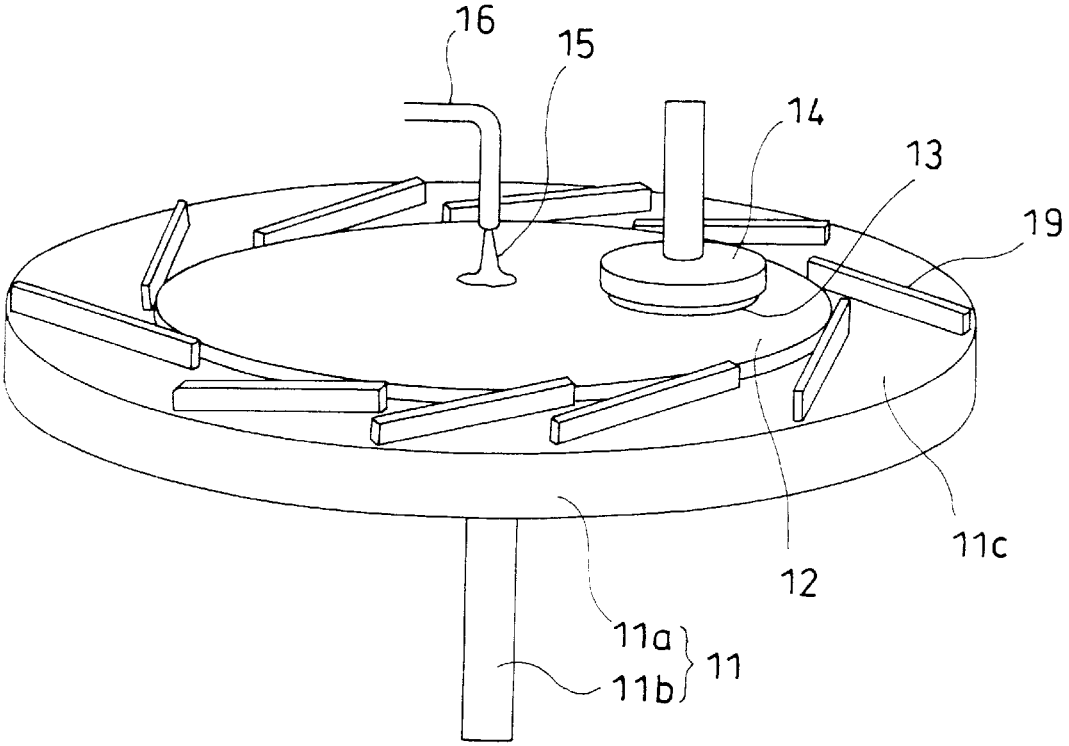
FIG. 11 is a perspective view of an apparatus for polishing a semiconductor substrate according to a fourth embodiment.
Figure 12:
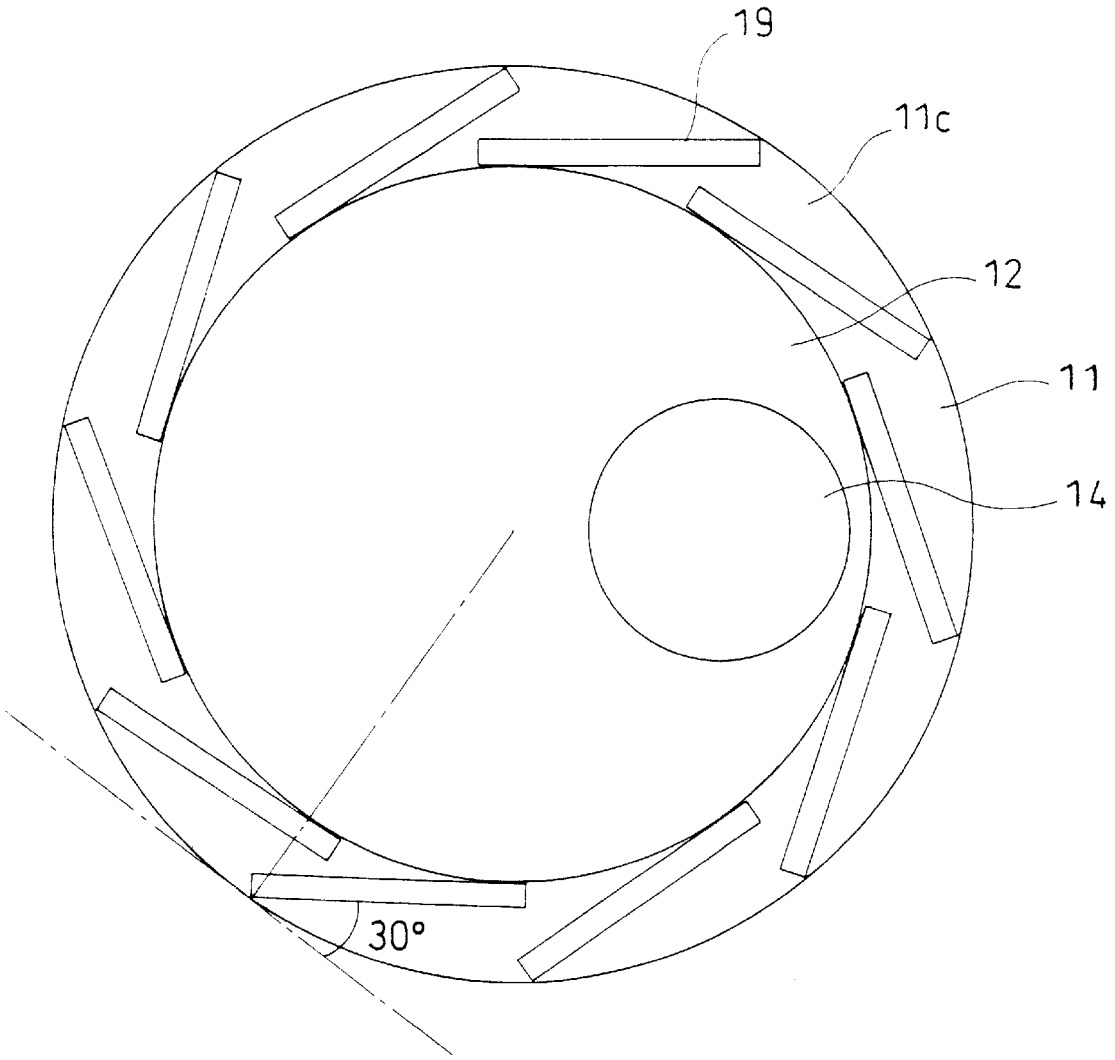
FIG. 12 is a plan view of the apparatus for polishing a semiconductor substrate according to the fourth embodiment.
Figure 13A:
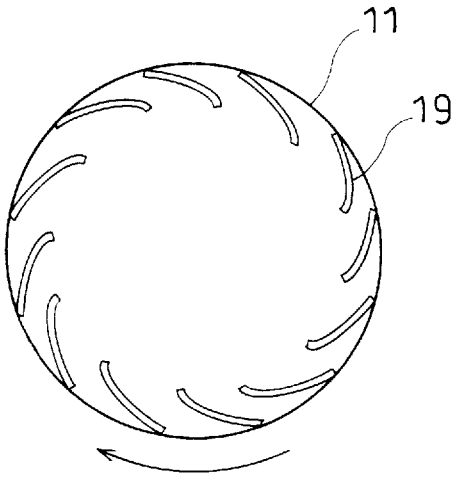
FIGS. 13(*a*) to 13(*d*) are plan views showing respective variations of a pushing plate in the apparatus for polishing a semiconductor substrate according to the fourth embodiment.
Figure 13B:
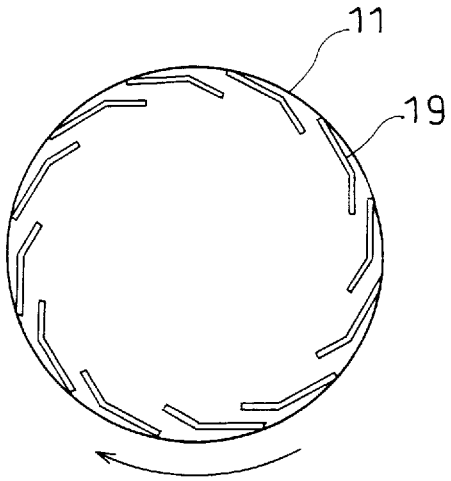
Figure 13C:
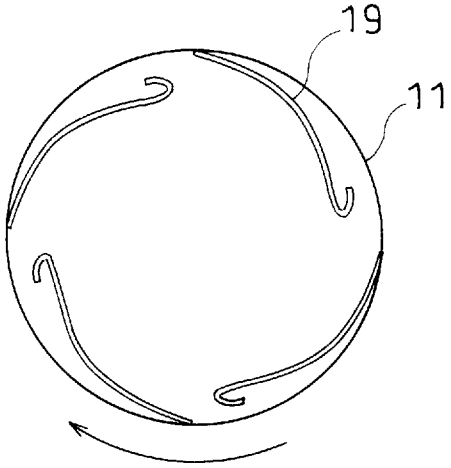
Figure 13D:
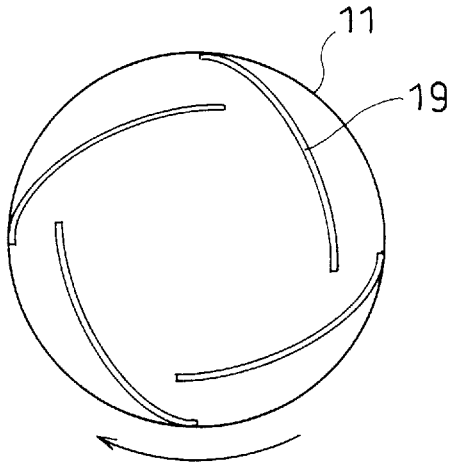

FIGS. 11 and 12 schematically show the construction of a polishing apparatus according to a fourth embodiment of the present invention, of which FIG. 11 is a perspective view and FIG. 12 is a plan view.

The fourth embodiment comprises: a platen 11; a polishing pad 12; a substrate holding head 14; and a slurry supply pipe 16, similarly to the first embodiment. A semiconductor substrate 13 is rotated and pressed against the polishing pad 12. A slurry 15 is supplied in a prescribed amount from the slurry supply pipe 16 onto the polishing pad 12.

The fourth embodiment is characterized in that the diameter of the polishing pad 12 is smaller than that of the platen 11 so that the polishing pad 12 is disposed on the central portion of the platen 11. On the other hand, a plurality of slat-like slurry holding members 19 made of, e.g., polyvinyl chloride are provided as slurry holding means along the outer circumferential surface of the polishing pad 12 to hold the slurry 15 on the polishing pad 12. Each of the slurry holding members 19 has such a height that the top position thereof is higher in level than the top surface of the polishing pad 12 and is positioned so that the inner portion thereof in a radial direction of the platen 1 is downstream of the outer portion thereof in the radial direction of the platen 1 in the direction of rotation of the platen 1 during polishing. Specifically, the slurry holding member 19 is fixed so that an angle of about 30 degrees is formed between the slurry holding member 19 and a tangent to the outer circumferential surface of the polishing pad 12.

As a general rule in the second embodiment, the slurry pushing member 18 does not rotate in conjunction with the polishing pad 12 so that the slurry 15 is pushed back to the central portion of the platen 11. As a general rule in the fourth embodiment, on the other hand, the slurry holding members 19 rotate in conjunction with the polishing pad 12 so that the slurry 15 is stored on the polishing pad 12. Specifically, the slurry 15 supplied from the slurry supply pipe 16 onto the polishing pad 12 and directed to the peripheral portion of the platen 11 by a centrifugal force accompanying the rotation of the platen 11 changes its direction in collision with the slurry holding members 19 and is stored on the polishing pad 12. Consequently, the slurry 15 is evenly spread over the polishing pad 12 when it is supplied to the semiconductor substrate 13.

The proper length and angle of the slurry holding member 19 can be selected such that the slurry 15 is held on the polishing pad 12. If any adjacent two of the holding members 19 are provided to overlap in the radial direction of the platen 11, the slurry 15 can be held more positively.

The slurry holding member 19 may be provided on the polishing pad 12, not on the peripheral portion 11*c* of the platen 11.

The material of the slurry holding members 19 is not limited to polyvinyl chloride. Any other material can be used instead, similarly to the second embodiment.

FIGS. 13(*a*) to 13(*d*) show variations of the configuration, placement angle, and number of the slurry holding member 19. As shown in the drawings, the configuration, placement angle, and number of the slurry holding member 19 are not particularly limited and can be varied properly depending on the viscosity of the slurry 15 and on the rotation speed of the platen 11. In other words, the slurry holding member 19 may be curved.

Below, a polishing method using the polishing apparatus according to the fourth embodiment will be described with reference to FIGS. 14(*a*) and 14(*b*) and FIGS. 15(*a*) and 15(*b*).

Figure 14A:
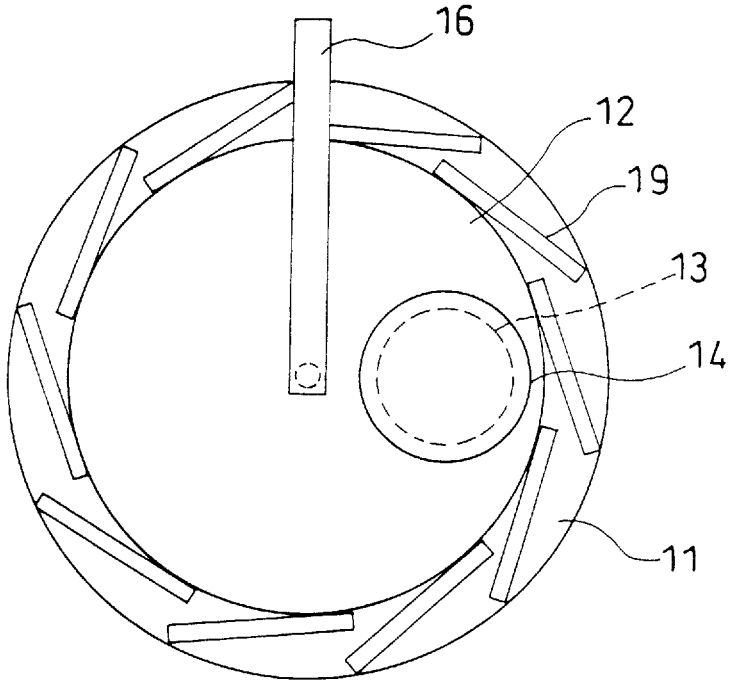
FIGS. 14(*a*) and 14(*b*) are perspective views each illustrating a polishing method using the apparatus for polishing a semiconductor substrate according to the fourth embodiment.
Figure 14B:
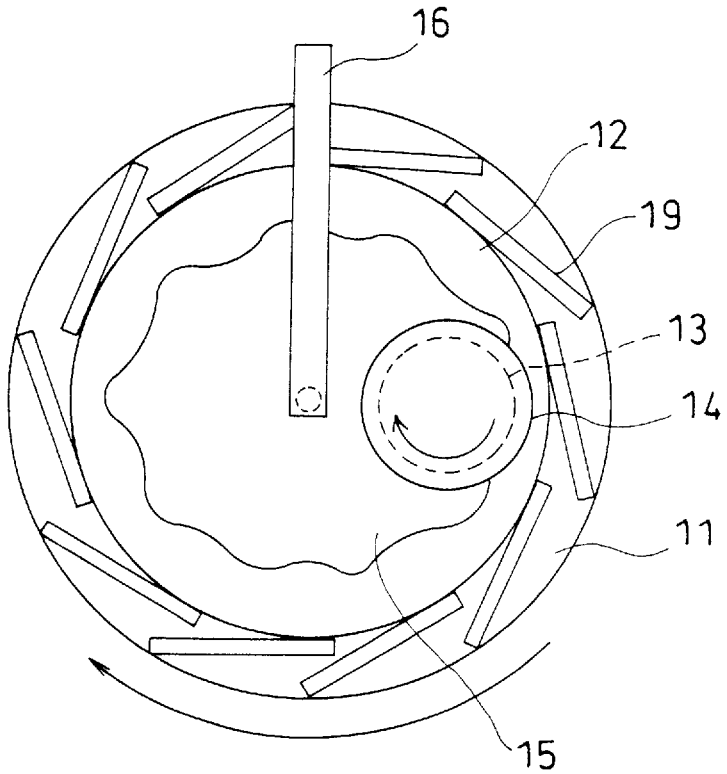

Initially, as shown in FIGS. 14(*a*), the semiconductor substrate 13 is attached to the substrate holding head 14 with a surface to the polished facing downward and pressed against the polishing pad 12.

Next, as shown in FIG. 14(*b*), the slurry 15 is supplied from the slurry supply pipe 16 onto a portion of the polishing pad 12 corresponding to the near-central portion of the platen 11, followed by the clockwise (CW) rotation of the platen 11 and substrate holding head 14. As a result, the slurry 15 flows toward the outside of the polishing pad 12 due to the centrifugal force accompanying the rotation of the platen 11 to be supplied to the interface between the semiconductor substrate 13 and the polishing pad 12.

Figure 15A:
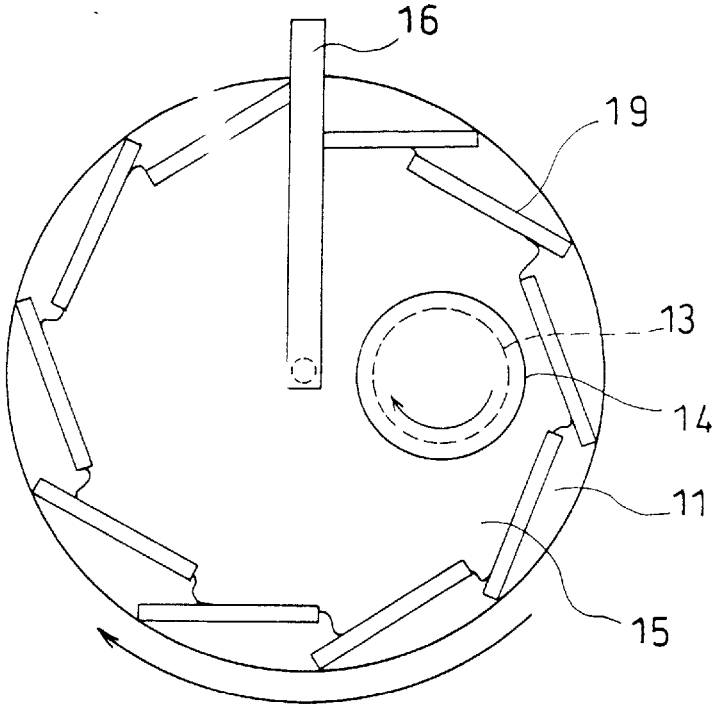
FIGS. 15(*a*) and 15(*b*) are perspective views each illustrating the polishing method using the apparatus for polishing a semiconductor substrate according to the fourth embodiment.
Figure 15B:
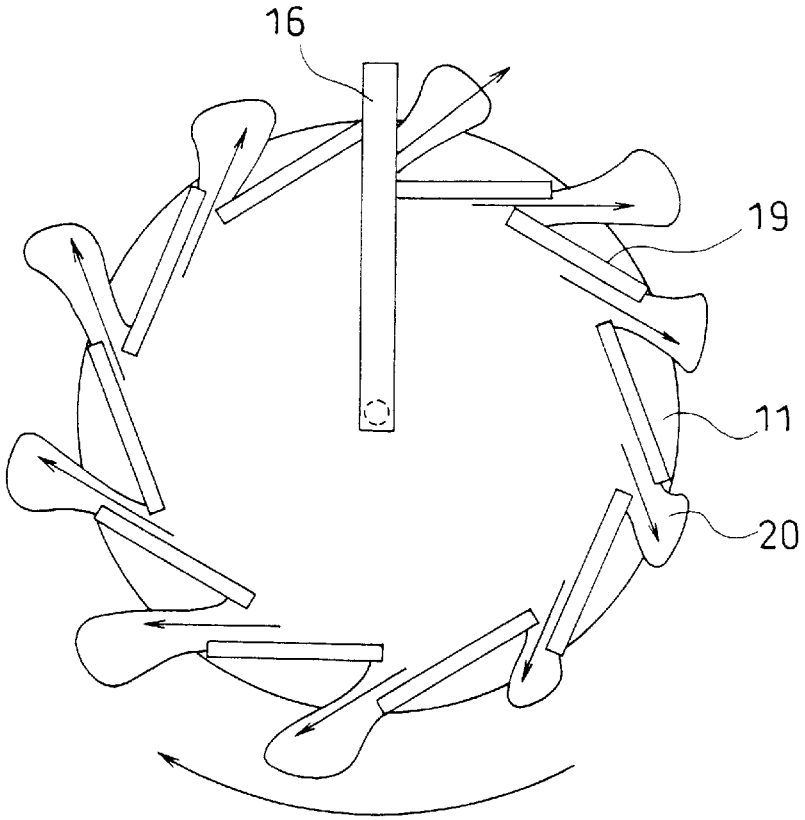

As shown in FIG. 15(*a*), the slurry 15 on the polishing pad 12 tends to flow toward the outside of the polishing pad 12 due to the centrifugal force accompanying the rotation of the platen 11, comes into contact with the inner surface of each slurry holding member 19, flows upstream in the direction of rotation of the platen 11 (from the outer portion of each slurry holding member 19 in the radial direction of the polishing pad 12 to the inner portion of the slurry holding member 19 in the radial direction of the polishing pad 12) along the inner surface of the slurry holding member 19, and then moves to the outer portion of the subsequent slurry holding member 19 in the radial direction of the polishing pad 12. By repeatedly performing the foregoing flowing movement, the slurry 15 is held on the polishing pad 12 and reused in the polishing of the semiconductor substrate 13.

When the polishing of the semiconductor substrate 13 is completed, a cleaning liquid such as water is supplied onto the polishing pad 12 to clean the polished surface of the semiconductor substrate 13 and rinse the slurry 15 out of the top surface of polishing pad 12. Thereafter, the platen 11 is rotated counterclockwise (CCW) to remove the cleaning liquid or the like remaining on the platen 11 and on the polishing pad 12. As a result, the cleaning liquid 20 exhibits a flowing movement in the direction opposite to the flowing movement of the slurry 15 described above as shown in FIG. 15(*b*), so that the cleaning liquid 20 is removed more efficiently than in the case where no slurry holding member 19 is provided.

Although the platen 11 is rotated CW during the polishing of the semiconductor substrate 13 and CCW during the removal of the cleaning liquid 20, the platen 11 is rotated CCW during the polishing of the semiconductor substrate 13 and CW during the removal of the cleaning liquid 20 in the case where the orientation in which the slurry holding member 19 is placed is radially reversed.

(Fifth Embodiment)

Figure 16A:
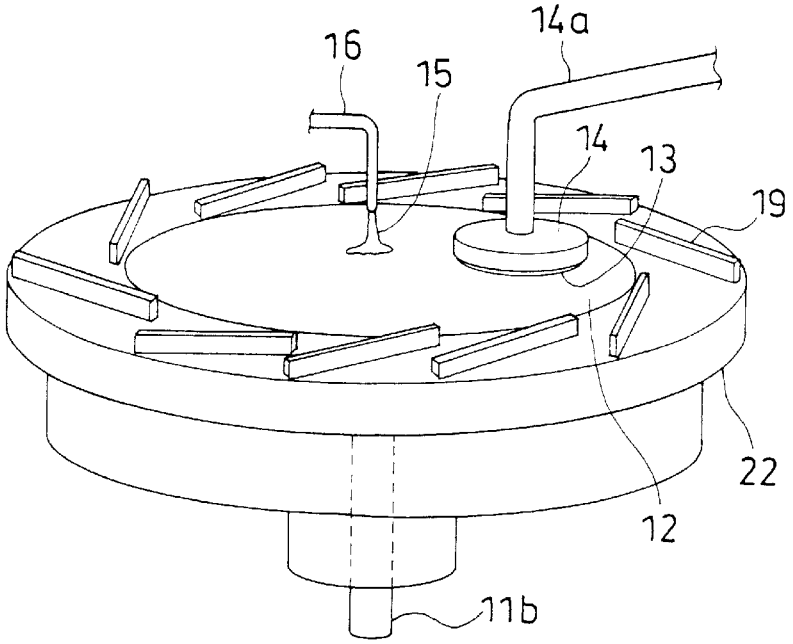
FIG. 16(*a*) is a perspective view of an apparatus for polishing a semiconductor substrate according to a fifth embodiment and FIG. 16(*b*) is a perspective view illustrating a polishing method using the apparatus for polishing a semiconductor substrate according to the fifth embodiment.
Figure 16B:
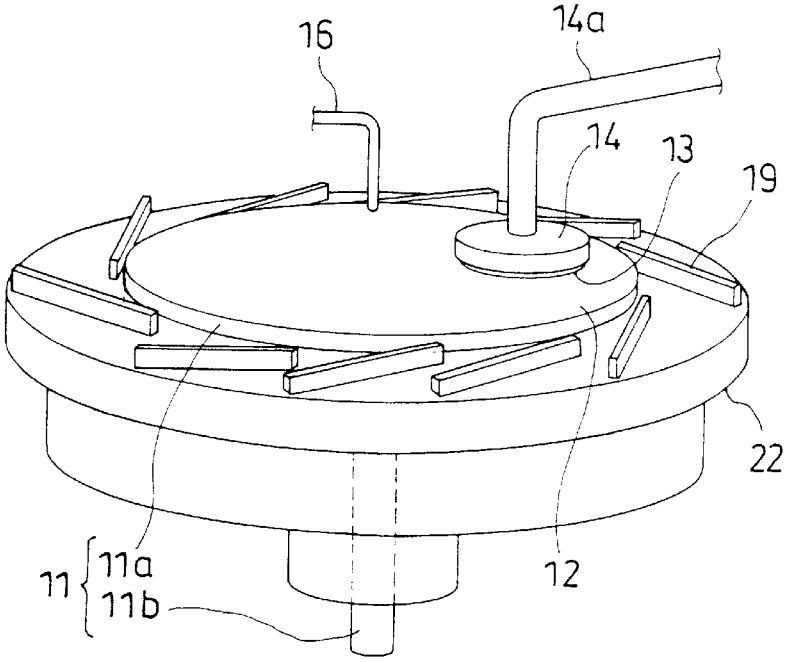

FIG. 16(*a*) is a schematic perspective view of a polishing apparatus according to a fifth embodiment of the present invention.

As shown in FIG. 16(*a*), the fifth embodiment also comprises a platen 11, a polishing pad 12, a substrate holding head 14, and a slurry supply pipe 16, similarly to the first embodiment. A semiconductor substrate 13 is rotated and pressed against the polishing pad 12 on the platen 11. A slurry 15 is supplied in a prescribed amount from the slurry supply pipe 16 onto the polishing pad 12. In FIG. 16(*a*), the drawing of a polishing-pad holder 11*a* of the platen 11 is omitted.

The fifth embodiment is characterized in that a ring-shaped vertically movable member 22 moving vertically relative to the platen 11 and rotated by rotating means other than the rotating means for the platen 11 is provided on the outside of the polishing-pad holder 11*a* of the platen 11. On the vertically movable member 22, a plurality of slat-like slurry holding members 19 having the same configuration as in the fourth embodiment is provided as the slurry holding means along the outer circumferential surface of the polishing pad 12 to hold the slurry 15 on the polishing pad 12. The slurry holding members 19 move vertically relative to the polishing pad 12 as the vertically movable member 22 moves vertically. The slurry holding member 19 is held such that the top position thereof becomes higher in level than the surface of the polishing pad 12 during polishing and that the top position thereof becomes lower in level than the surface of the polishing pad 12 during cleaning.

The fifth embodiment is also characterized in that an arm 14*a* of the substrate holding head 14 performs a rotary movement over the surface of the polishing pad 12.

The two-dimensional arrangement of the slurry holding members 19 is the same as in the fourth embodiment so that the slurry 15 supplied from the slurry supply pipe 16 onto the polishing pad 12 and directed to the peripheral portion of the platen 11 by the centrifugal force accompanying the rotation of the platen 11 changes its direction in collision with the slurry holding members 19 and is stored on the polishing pad 12. As a result, the slurry 15 is evenly spread over the polishing pad 12 before it is used in the polishing of the semiconductor substrate 13.

Below, a polishing method using a polishing apparatus according to the fifth embodiment will be described with reference to FIGS. 16(*a*) and 16(*b*) and FIGS. 17(*a*) and 17(*b*).

Initially, the semiconductor substrate 13 is attached to the substrate holding head with a surface to be polished facing downward and pressed against the polishing pad 12.

Next, the slurry 15 is supplied from the slurry supply pipe 16 onto a portion of the polishing pad 12 corresponding to the near-central portion of the platen 11, followed by individual rotations of the platen 11 and the substrate holding head 14. As a result, the slurry 15 flows toward the outside of the polishing pad 12 due to a centrifugal force accompanying the rotation of the platen 11 and is supplied to the interface between the semiconductor substrate 13 and the polishing pad 12. In this case, the slurry 15 on the polishing pad 12 tends to flow toward the outside of the polishing pad 12 due to the centrifugal force accompanying the rotation of the platen 11, charges its flow direction in collision with the slurry holding member 19, is stored on the polishing pad 12, and evenly spread over the polishing pad 12 before it is used to polish the semiconductor substrate 13.

When the polishing of the semiconductor substrate 13 is completed, the vertically movable member 22 is moved downward relative to the platen 11, as shown in FIG. 16(*b*).

Figure 17A:
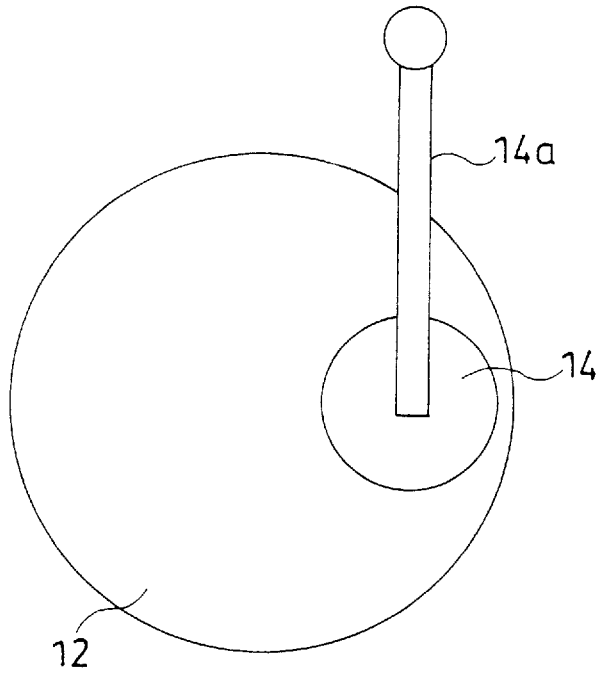
FIGS. 17(*a*) and 17(*b*) are plan views illustrating the polishing method using the apparatus for polishing a semiconductor substrate according to the fifth embodiment.
Figure 17B:
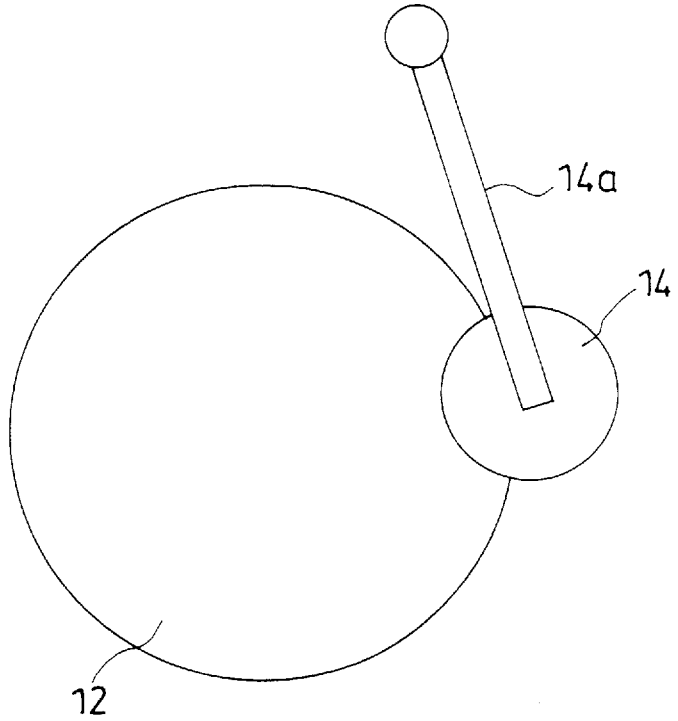

Next, as shown in FIGS. 17(*a*) and 17(*b*), the arm 14*a* of the substrate holding head 14 is rotated along the surface of the polishing pad 12 so that a part of the substrate holding head 14 and therefore a part of the semiconductor substrate 13 thrust out from the polishing pad 12. Consequently, the adhesion of the polishing pad 12 to the semiconductor substrate 13 is reduced to permit easy removal of the semiconductor substrate 13 from the polishing pad 12.

Figure 18A:
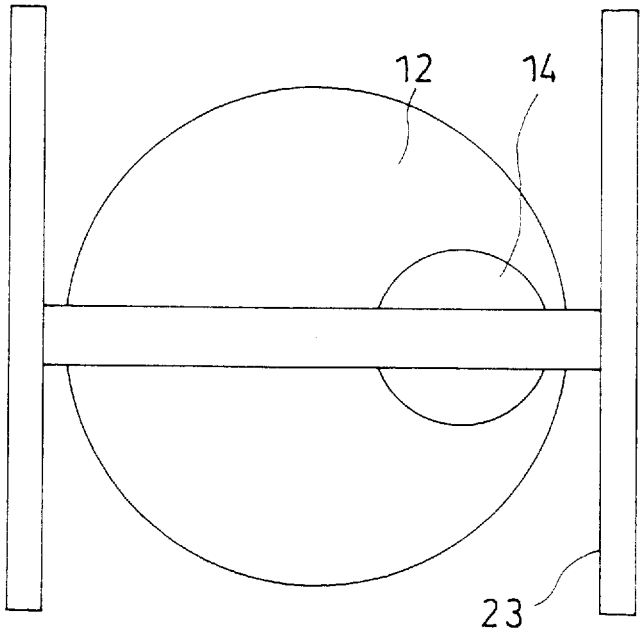
FIGS. 18(*a*) and 18(*b*) are plan views illustrating a polishing method using a variation of the apparatus for polishing a semiconductor substrate according to the fifth embodiment.
Figure 18B:
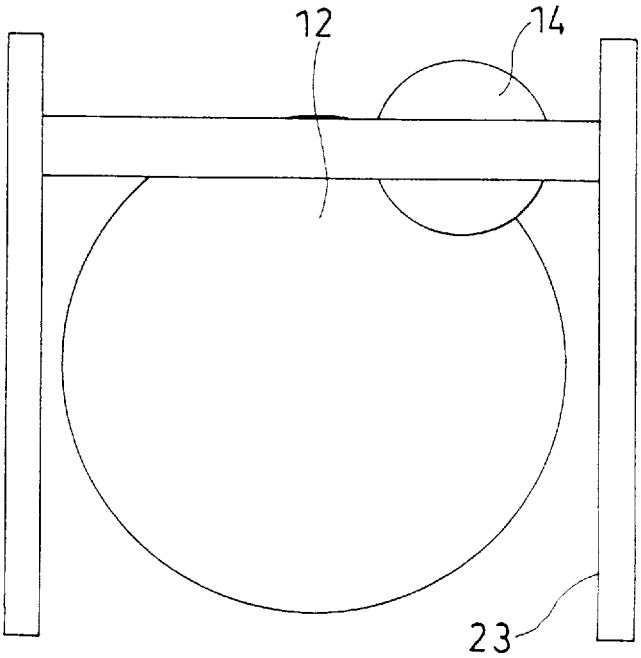

FIGS. 18(*a*) and 18(*b*) show another structure in which the substrate holding head 14 is moved along the surface of the polishing pad 12. The substrate holding head 14 is held by a horizontal movable member 23 moving horizontally in parallel with the surface of the polishing pad 12.

When the polishing of the semiconductor substrate 13 is completed, the vertically movable member 22 is moved downward relative to the platen 11 as shown in FIG. 16(*b*) and then the horizontal movable member 23 is moved horizontally as shown in FIGS. 18(*a*) and 18(*b*) to move the substrate holding head 14 along the surface of the polishing pad 12. Consequently, a part of the substrate holding head 14 and therefore a part of the semiconductor substrate 13 thrust out from the polishing pad 12, so that the semiconductor substrate 13 is removed easily from the top surface of the polishing pad 12.

(Sixth Embodiment)

Figure 19:
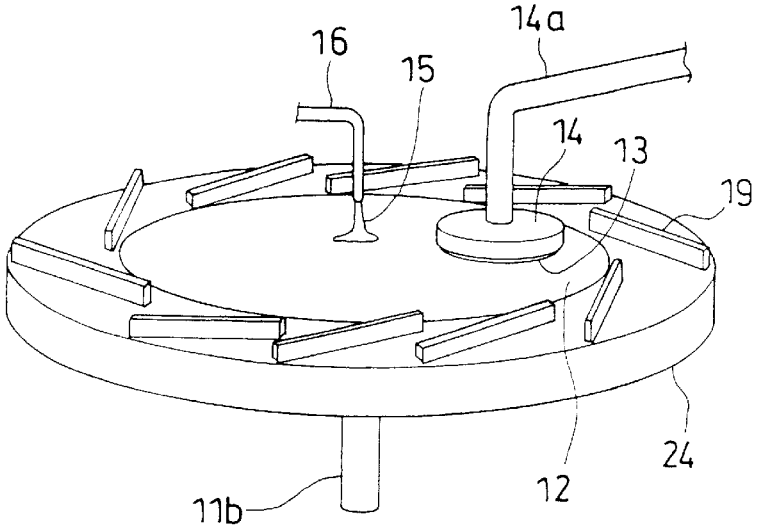
FIG. 19 is a perspective view of an apparatus for polishing a semiconductor substrate according to a sixth embodiment.

FIG. 19 schematically shows the plan configuration of a polishing apparatus according to a sixth embodiment of the present invention.

As shown in FIG. 19, the sixth embodiment also comprises a platen 11, a polishing pad 12, a substrate holding head 14, and a slurry supply pipe 16, similarly to the first embodiment. A semiconductor substrate 13 is rotated and pressed against the polishing pad 12 on the platen 11. A slurry 15 is supplied in a prescribed amount from the slurry supply pipe 16 onto the polishing pad 12. In FIG. 19, the drawing of a polishing-pad holder 11*a* of the platen 11 is omitted.

The sixth embodiment is characterized in that a ring-shaped rotary member 24 rotated in a plane vertical to the surface of the polishing pad 12 by rotating means other than the rotating means for the platen 11 is provided outside the polishing-pad holder 11*a* of the platen 11. The drawing of a mechanism for rotating the rotary member 24 is omitted here. On the rotary member 24, a plurality of slat-like slurry holding members 19 having the same configuration as in the fourth embodiment are provided as the slurry holding means along the outer circumferential surface of the polishing pad 12 to hold the slurry 15 on the polishing pad 12. The slurry holding member 19 rotates relative to the polishing pad 12 with the rotation of the rotary member 24. The slurry holding member 19 is held so that the top position thereof becomes higher in level than the surface of the polishing pad 12 during polishing.

An arm 14*a* of the substrate holding head 14 is provided to perform a rotary movement over the surface of the polishing pad 12, similarly to the fifth embodiment.

The two-dimensional arrangement of the slurry holding member 19 is the same as in the fourth embodiment so that the slurry 15 supplied from the slurry supply pipe 16 and directed to the peripheral portion of the platen 11 by a centrifugal force accompanying the rotation of the platen 11 changes its direction in collision with the slurry holding member 19 and is stored on the polishing pad 12. As a result, the slurry 15 is evenly spread over the polishing pad 12 before it is used in the polishing of the semiconductor substrate 13.

Below, a polishing method using the polishing apparatus according to the sixth embodiment will be described with reference to FIGS. 19 and 20.

Initially, as shown in FIG. 19, the slurry 15 is supplied from the slurry supply pipe 16 onto a portion of the polishing pad 12 corresponding to the near-central portion of the platen 11, while the platen 11 and the substrate holding head 14 are rotated individually. As a result, the slurry 15 flows toward the outside of the polishing pad 12 due to the centrifugal force accompanying the rotation of the platen 11 and is supplied to the interface between the semiconductor substrate 13 and the polishing pad 12. In this case, the slurry 15 on the polishing pad 12 tends to flow to the outside of the polishing pad 12 due to the centrifugal force accompanying the rotation of the platen 11 but changes its direction in collision with the slurry holding member 19 and is stored on the polishing pad 12. As a result, the slurry 15 is evenly spread over the polishing pad 12 before it is used in the polishing of the semiconductor substrate 13.

Figure 20:
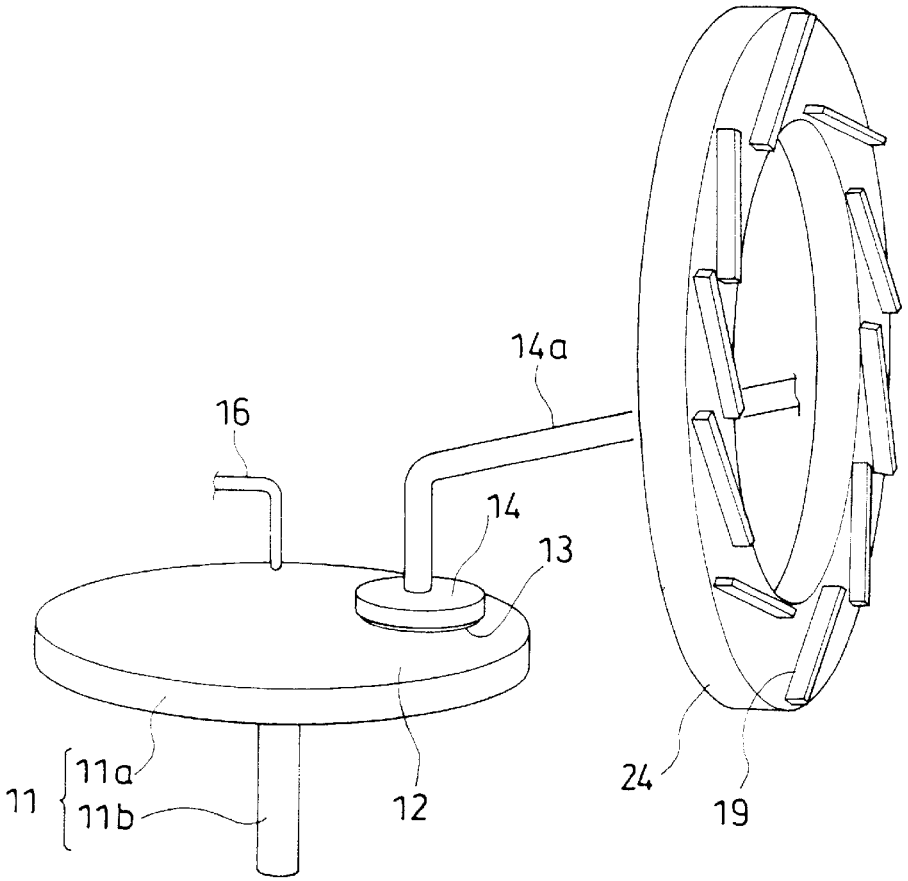
FIG. 20 is a perspective view of a polishing method using the apparatus for polishing a semiconductor substrate according to the sixth embodiment.

When the polishing of the semiconductor substrate 13 is completed, the rotary member 24 is rotated in a plane vertical to the surface of the polishing pad 12, as shown in FIG. 20, and then the arm 14*a* of the substrate holding head 14 is rotated over the surface of the polishing pad 12 so that a part of the substrate holding head 14 and therefore a part of the semiconductor substrate 13 thrust out from the polishing pad 12, similarly to the fifth embodiment. Consequently, the adhesion of the polishing pad 12 to the semiconductor substrate 13 is reduced to permit easy removal of the semiconductor substrate 13 from the polishing pad 12.

As shown in FIGS. 18(*a*) and 18(*b*), the substrate holding head 14 may be held by a horizontal movable member 23 moving horizontally in parallel with the surface of the polishing pad 12 so that a part of the substrate holding head 14 and therefore a part of the semiconductor substrate 13 thrust out from the polishing pad 12.

Figure 21:
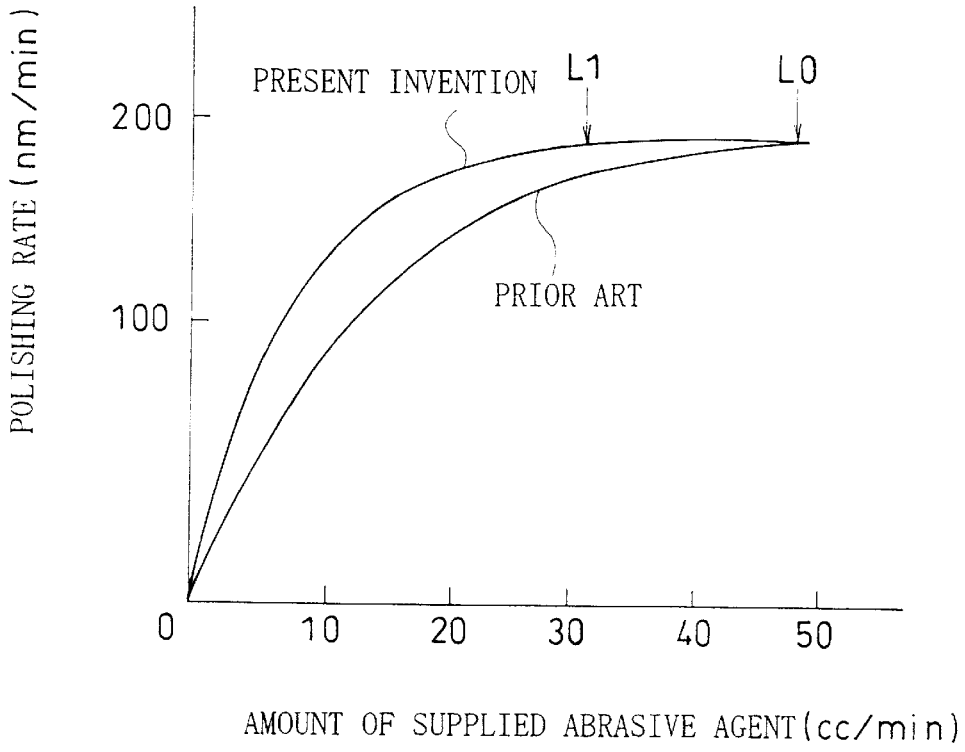
FIG. 21 is a view showing respective relationships between the amounts of slurry and polishing rates during polishing performed by using the apparatus for polishing a semiconductor substrate according to the present invention and a conventional apparatus for polishing a semiconductor substrate.
Figure 22:
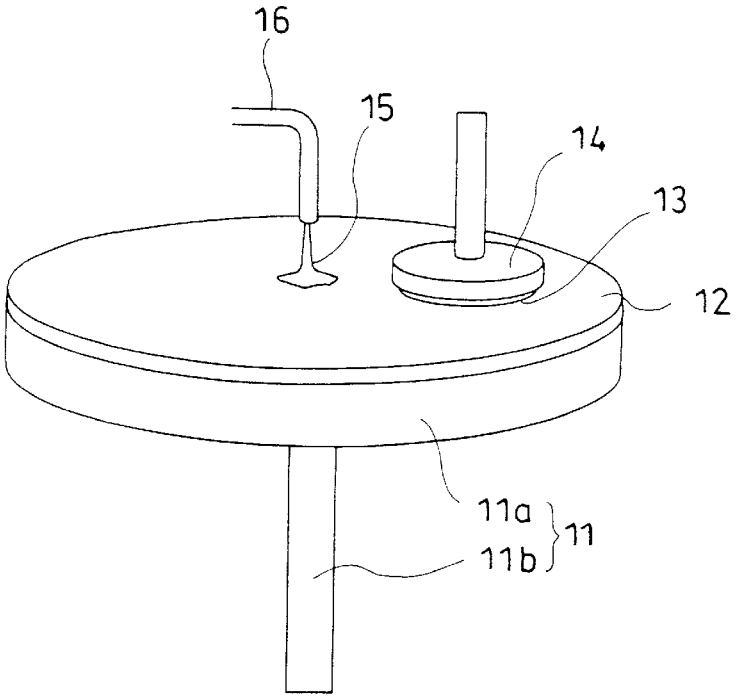
FIG. 22 PRIOR ART
FIG. 22 is a schematic perspective view of the conventional apparatus for polishing a semiconductor substrate.

FIG. 21 shows respective relationships between the amounts of supplied slurry and the polishing rates in the case where polishing is performed by using the polishing apparatus according to the individual embodiments of the present invention and in the case where polishing is performed by using the conventional polishing apparatus. Although the amount of supplied slurry required to maintain a sufficient polishing rate is L0 in the conventional embodiment, the present invention requires L1, which is smaller than L0, to maintain a polishing rate on the same order as in the conventional embodiment.

We claim:

1. A method of polishing a semiconductor substrate, comprising:

supplying a slurry onto a polishing pad disposed on a flat surface of a platen rotating around a shaft vertical to said flat surface;

rotating the platen thus causing said slurry to flow to a peripheral edge of said platen;

polishing a semiconductor substrate by pressing it against said polishing pad; and pushing said slurry, which is caused to flow to the peripheral portion of said platen to a central portion of said platen by a slurry pushing means which extends over the peripheral edge of said platen.

2. A method of polishing a semiconductor substrate according to claim 1, wherein said slurry pushing step includes a step of pushing the slurry on said polishing pad to the central portion of said platen by means of a pushing plate having an inner portion and an outer portion, said outer portion extending over the peripheral edge of the platen, said pushing plate intersecting a radius of the platen and angled towards the direction of rotation of the platen during polishing.

3. A method of polishing a semiconductor substrate according to claim 2, wherein said slurry pushing step includes a step of pushing the slurry supplied onto said polishing pad to the central portion of said platen by means of a pushing plate having a spacing located between the pushing plate and a top surface of said polishing pad, with a thickness less than or equal to a layer of slurry on said polishing pad.

4. A method of polishing a semiconductor substrate according to claim 1, wherein said slurry pushing step includes a step of pushing the slurry on said polishing pad to the central portion of said platen by means of said pushing plate make of a flexible material and provided such that a back surface thereof is in contact with a top surface of said polishing pad.

5. A method of polishing a semiconductor substrate according to claim 1, further comprising removing a cleaning liquid supplied onto said polishing pad by rotating said slurry pushing means in a direction opposite to the rotation of the platen during polishing.

6. A method of polishing a semiconductor substrate according to claim 1, wherein said slurry pushing step includes a step of pushing the slurry on said polishing pad to the central portion of said platen by means of a rotary member provided in contact with or slightly spaced from a top surface of said polishing pad and rotating in a direction opposite to the rotation of said platen.

7. A method of polishing a semiconductor substrate, comprising:

supplying a slurry onto a polishing pad disposed on a flat surface of a platen rotating around a shaft vertical to said flat surface;

rotating the slurry pushing means thus causing said slurry to flow to a peripheral edge of said platen;

polishing a semiconductor substrate by pressing it against said polishing pad; and holding the slurry supplied onto said polishing pad by a slurry holding means having a plurality of slurry holding members spaced along the periphery of said platen angled in the direction of rotation of the platen during polishing.

8. A method of polishing a semiconductor substrate according to claim 7, wherein said slurry holding step includes a step of holding the slurry on said polishing pad by means of a plurality of slurry holding members spaced along the periphery of said platen.

9. A method of polishing a semiconductor substrate according to claim 7, further comprising removing a cleaning liquid supplied onto said polishing pad by rotating said slurry holding means in a direction opposite to the rotation of the platen during polishing.

10. A method of polishing a semiconductor substrate according to claim 7, further comprising:

a slurry-holding-member moving step of moving said slurry holding member upwardly, downwardly, or outwardly from said polishing pad; and a substrate moving step of moving said semiconductor substrate in a plane in parallel with said polishing pad such that at least a part of said semiconductor substrate thrusts out from said polishing pad.

* * * * *